US011471358B1

(12) United States Patent
McCullough

(10) Patent No.: US 11,471,358 B1
(45) Date of Patent: Oct. 18, 2022

(54) FASCIA ACTIVATION AND TRAINING DEVICE AND METHODS OF USE

(71) Applicant: Meena McCullough, Euless, TX (US)

(72) Inventor: Meena McCullough, Euless, TX (US)

( * ) Notice: Subject to any disclaimer, the term of this patent is extended or adjusted under 35 U.S.C. 154(b) by 0 days.

(21) Appl. No.: 17/489,479

(22) Filed: Sep. 29, 2021

Related U.S. Application Data

(60) Provisional application No. 63/084,878, filed on Sep. 29, 2020.

(51) Int. Cl.
*A61H 1/02* (2006.01)
*A63B 21/055* (2006.01)

(52) U.S. Cl.
CPC ... *A61H 1/0237* (2013.01); *A61H 2201/0192* (2013.01); *A61H 2201/1253* (2013.01); *A61H 2201/1642* (2013.01)

(58) Field of Classification Search
CPC .... A61H 2201/1253; A61H 2201/1261; A61H 2201/164; A61H 2201/1642; A61H 2015/0014; A61H 2015/0057; A61H 15/00; A61H 2205/106; A63B 21/05; A63B 21/4025; A63B 21/4045; A63B 21/00185; A63B 23/0488; A63B 2023/006; A63B 21/00043; A63B 21/0442; A63B 21/4015; A63B 23/08–10; A63B 69/0059–0062
See application file for complete search history.

(56) References Cited

U.S. PATENT DOCUMENTS 605,237 A * 6/1898 Spink ..... A63B 21/0004 482/129
2,630,801 A * 3/1953 Mest ..... A61F 5/0193 280/11.33
2,760,774 A * 8/1956 Perez ..... A63B 21/4015 482/79
3,174,343 A * 3/1965 Kasulis ..... A63B 21/0087 482/112
3,343,837 A * 9/1967 Grzybowski ..... A63B 21/0004 482/126
3,544,106 A * 12/1970 Barrett ..... A63B 21/05 482/126
3,638,939 A * 2/1972 Langley ..... A61H 1/0244 15/230.11
3,971,255 A * 7/1976 Varney ..... A61B 5/224 482/909

(Continued)

FOREIGN PATENT DOCUMENTS

KR 101481367 B1 1/2015
KR 102041013 B1 11/2019

*Primary Examiner* — Justine R Yu
*Assistant Examiner* — Christopher E Miller

(57) ABSTRACT

Fascia activation and training devices having an adjustable length, collapsible, elongate device body having opposing ends to which open ended interchangeable cuffs are removably mounted. The end cuffs of the training devices provide for inward and/or outward compression forces to be applied by a user's body members engaging such end cuffs, thereby enhancing fascial activation and training, and providing users with proprioceptive feedback, making motor learning in biomechanical retraining through fascia remodeling possible. Methods of use of such training devices provide for the use of multiple types of training devices in combination, resulting in the enhanced training of biomechanical chains of muscles.

20 Claims, 18 Drawing Sheets

(56) References Cited

U.S. PATENT DOCUMENTS 4,186,688 A * 2/1980 Gaitan ..... A61D 3/00 119/816
4,376,533 A * 3/1983 Kolbel ..... A63B 23/03525 482/125
4,602,782 A * 7/1986 Carlson ..... A63B 21/1654 482/140
4,733,861 A * 3/1988 Plunkett, III ..... A63B 21/0552 482/125
4,909,505 A * 3/1990 Tee ..... A63B 21/0552 482/121
4,955,608 A * 9/1990 Dougherty ..... A63B 69/38 473/215
5,039,093 A * 8/1991 Collier ..... A63B 21/4011 482/79
5,176,377 A * 1/1993 Wilkinson ..... A63B 21/4021 482/125
5,254,064 A * 10/1993 Rock ..... A63B 22/0012 482/129
5,318,494 A * 6/1994 Santighian ..... A63B 21/0004 482/121
5,362,305 A * 11/1994 Varn ..... A61F 5/0193 128/882
5,558,628 A * 9/1996 Bzoch ..... A61F 5/0193 128/882
5,653,668 A * 8/1997 Wilkinson ..... A63B 21/4003 482/121
5,674,164 A * 10/1997 Kravitz ..... A63B 21/0004 482/121
5,681,270 A * 10/1997 Klearman ..... A61F 5/0193 128/845
5,697,873 A * 12/1997 Van Straaten ..... A63B 23/0488 482/122
5,911,535 A * 6/1999 Gvoich ..... A63B 23/0482 482/126
6,110,078 A * 8/2000 Dyer ..... A61H 1/0266 482/121
6,254,561 B1 * 7/2001 Borden ..... A61N 5/1049 128/845
6,348,026 B1 * 2/2002 Kuo ..... A63B 21/0552 482/904
7,137,935 B2 * 11/2006 Clarke ..... A63B 21/1609 482/904
7,628,741 B2 * 12/2009 Adcock ..... A63B 23/1281 482/122
9,586,074 B2 * 3/2017 Autogue ..... A63B 21/00178
9,872,793 B2 * 1/2018 Janning ..... A61F 5/0104
10,758,769 B2 * 9/2020 Aihara ..... A63B 21/4035
11,285,356 B2 * 3/2022 Marti ..... A63B 23/03525
2003/0088198 A1 5/2003 Carpenter
2006/0073955 A1 * 4/2006 Garcia Lopez .... A63B 21/4009 482/121
2006/0235343 A1 10/2006 Fitzmaurice
2007/0161479 A1 * 7/2007 Harris ..... A63B 21/00072 482/148
2007/0197356 A1 * 8/2007 Miller ..... A63B 21/4045 482/112
2007/0287604 A1 * 12/2007 Lee ..... A61H 1/0244 482/92
2008/0026863 A1 * 1/2008 Eck ..... A63B 69/3623 473/212
2008/0081747 A1 * 4/2008 Mok ..... A63B 21/0552 482/121
2009/0143204 A1 * 6/2009 Gronda ..... A63B 23/1254 482/112
2009/0197692 A1 * 8/2009 Eck ..... A63B 69/0059 473/409
2011/0124473 A1 * 5/2011 Kole ..... A63B 21/02 482/79
2012/0100967 A1 * 4/2012 Leibowitz ..... A63B 21/4013 482/124
2013/0085045 A1 * 4/2013 Chavez ..... A63B 23/03575 482/93
2014/0031183 A1 * 1/2014 Blake ..... A63B 21/0552 482/130
2014/0272858 A1 * 9/2014 Fattori ..... A63B 69/18 434/253
2016/0256344 A1 * 9/2016 Lee ..... A63B 23/0488
2017/0354842 A1 * 12/2017 Boland ..... A63B 21/4027
2018/0311102 A1 * 11/2018 Frankson ..... A61H 1/0266
2019/0091090 A1 * 3/2019 Koskela ..... A61H 1/0266
2019/0110948 A1 * 4/2019 Bradbury Goulsby ..... A61H 1/0244
2019/0351278 A1 * 11/2019 Walker ..... A41D 1/08
2020/0360756 A1 * 11/2020 Ware ..... A63B 21/4043

* cited by examiner

FASCIA ACTIVATION AND TRAINING DEVICE AND METHODS OF USE

CROSS-REFERENCE TO RELATED APPLICATIONS

This application claim priority to Provisional Patent Application No. 63/084,878, filed Sep. 29, 2020, titled "Foot Therapy System and Method of Use," which is hereby incorporated by reference in its entirety.

BACKGROUND OF THE INVENTION

Technical Field

The invention(s) disclosed herein relate generally to devices and methods for providing therapy to humans, and more specifically, to a fascia activation and training device, and methods of use thereof to train the body's fascia in newer, faster, and more effective ways as compared to traditional muscle exercises and stretching techniques.

Description of Related Art

Billions of people suffer from pain every year, causing missed work, excessive medical costs, lost quality of life, and disability. Many injuries present as "chronic." These injuries/pains often are developing in our bodies while we don't know it until pain starts sending signals to our brain. Fascia is the human body's largest organ. It contains more pain receptors than muscle, and different principles of movement that guide its healing, training, and rebuilding. A problem results when fascia becomes stiff, which can result is humans having faulty patterns of movement. One example of such faulty patterns of movements that occur due to stiff fascia is poor foot and ankle posture through excessive supination or pronation. The ability to have a flexible foot to change this position when needed for different movements through our daily life. If there is excessive stiffness in either pronation or supination this can cause a collapsing of the knees, valgus collapse, lack of tibial advancement during gate cycle stance phase, inactive hamstrings or glute muscles, and ultimately pain in any joint up the continent chain from the foot to the back. Tight fascia (connective tissue) also compresses on arteries, nerves, veins and joint spaces. This is not able to be picked up at the initial and moderate stages of compression until a secondary problem develops causing severe nerve pain, decreased blood flow or grinding cartilage. MRIs cannot currently show that tight/stiff facia is the source of such secondary problems.

Fascia is the connective tissue of different densities in different areas of the body depending on the purpose needed. Sheets of it crisscross the body around and through muscles, organs, and bone. Essentially, fascia it is the flexible glue that supports and holds the body together. More specifically, fascia is the soft tissue component of the connective tissue system that permeates the human body, which forms a continuous three-dimensional matrix of the entire body, which extends to all fibrous connective tissues, including the aponeurosis, ligaments, tendons, retinaculum, joint capsules, tunics of organs and vessels, epineurium, meninges, periosteum and all the intermuscular fibers of the myofascia, up to the endomysium, with the function of structural and nutritional support, transmission of force and communication. More discoveries of fascia are being found now more than ever before because it is a newly researched tissue. Scientists and anatomists historically have not studied these connective tissues in depth because in cadaver dissections they cut it out to view and study other structures of the body. Research now reveals cells in it that can increase in number if trained. These cells have the purpose of sensing where the body is in space, how the joints are positioned together, secrete lubricative fluid, and remodel the shape of the connective tissue itself. This essentially allows our body's tissues to slide better on each other and decreases the chance of injury, vessel restriction, and pain. Fasciacytes are a specific type of cell discovered. An increased number of these Fasciacyte cells are found specifically in the connective tissue casing surrounding bones, also known as the periosteum. If trained correctly these cells can proliferate, increasing lubrication to the area and increasing the elasticity of the tissue. With increased cells present, fascia has the ability to contract-similar to muscle. Transmitting kinetic forces through the body in a chain reaction and recoil-like quality.

Prior art therapy devices and methods used by therapists and other healthcare providers to treat tightness in the fascia have suffered from various drawbacks. For example, efforts have been made by therapists to attempt to mobilize connective tissues with their bodies and hands. However, therapists typically find great difficulty in placing their body into the proper position needed with the counter force required to most effectively make a lasting effect in causing relief. Another drawback of using hands to tactilely queue a patient into correct position, provide audible cues to guide a patient into position, or to demonstrate correct positioning, is that the patient does not actually feel what they're supposed to do with respect to positioning, or feel what they are supposed to feel at all times with respect to positioning. In other words, such methods do not provide the patient with proprioceptive feedback that they need to be in the correct position, resulting in inadequate treatment.

Further, many therapists also only address the area in pain, and sometimes potentially the areas above and below the area of pain. However, this does not account for the chain reaction forces occurring constantly through the body on a daily basis, therefore such techniques do not sufficiently affect the entire structure and foundation to give the change that the body requires. Further, exercise enthusiasts, athletes and rehab specialists have in the past used bands and balls in an attempt to mobilize connective tissues. However, such devices do not provide a hard stop to mobilize bones. In other words, the give of, for example, a ball or ring, does not provide the leverage needed to shear the facial connective tissue. Foam rolling and trigger point balls to treat fascia and other passive techniques suffer drawbacks in that they only work the outside of the body, directly under the skin. Active exercise and yoga techniques even with the current equipment available likewise suffer drawbacks in that they don't stabilize the joint arthrokinematics to fully activate the mechanoreceptors in the fascia.

Therefore, what is needed are fascia activation and training devices, and associated methods of use, that provide training of correct transmission of force through a patient's body and namely, provide correct biomechanics to alleviate the pain of pathological and injury conditions through mobilizing the body's fascial connective tissue. What is also needed are fascia activation and training devices, and methods of use therefor, which provide patients with proprioceptive feedback that they need to be in the correct position when engaging in therapy, making motor learning in biomechanical retraining through fascia remodeling possible. What is also needed are fascia activation and training devices, and methods of use therefor, which provide patients with a way to shear connective tissue fascia, mobilizing it of a boney areas so as to biomechanically align the patient's body. These and other needs are met by the embodiments, and the steps, of the fascia activation and training devices, and methods of use therefor, described below with reference to the accompanying drawings.

BRIEF DESCRIPTION OF THE SEVERAL VIEWS OF THE DRAWINGS

The invention(s) will be more fully understood by reference to the following detailed description of the preferred and alternate embodiments when read in conjunction with the accompanying drawings, wherein.

Figure 1:
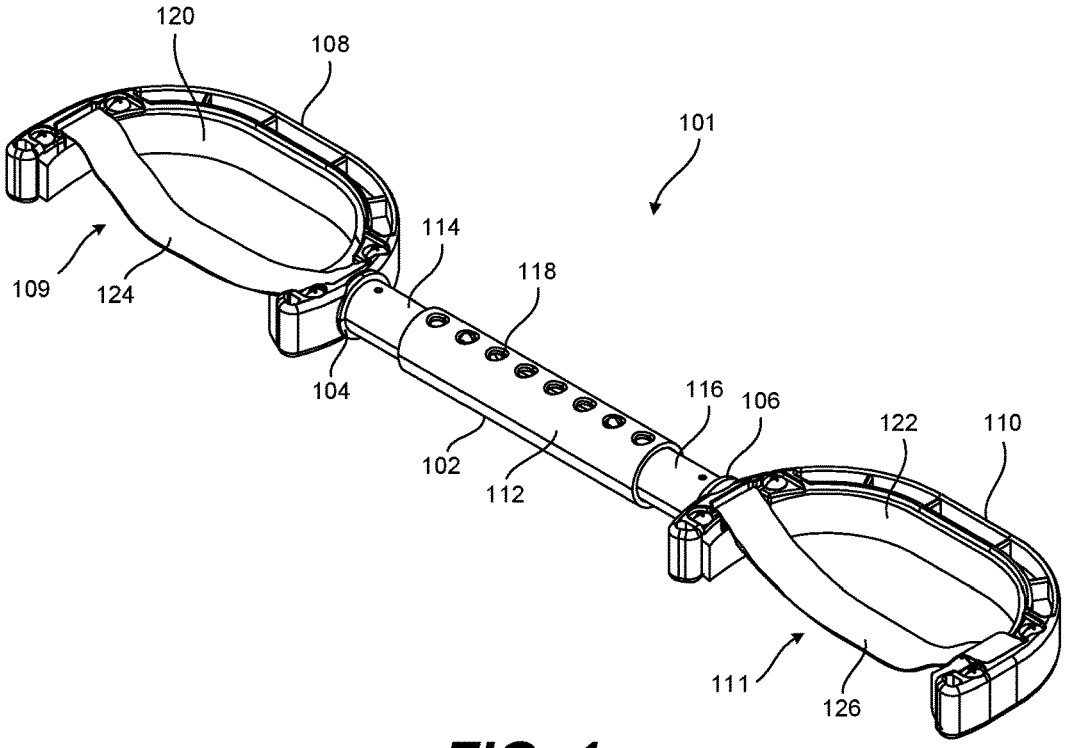
FIG. 1 is a perspective view of an embodiment of the fascia activation and training device in accordance with aspects of the present disclosure.

The above figures are provided for the purpose of illustration and description only, and are not intended to define the limits of the disclosed invention. Use of the same reference number in multiple figures is intended to designate the same or similar parts. Furthermore, if and when the terms "top," "bottom," "first," "second," "upper," "lower," "height," "width," "length," "end," "side," "horizontal," "vertical," and similar terms are used herein, it should be understood that these terms have reference only to the structure shown in the drawing and are utilized only to facilitate describing the particular embodiment. The extension of the figures with respect to number, position, relationship, and dimensions of the parts to form the preferred embodiment will be explained or will be within the skill of the art after the following teachings of the inventions disclosed herein have been read and understood.

DETAILED DESCRIPTION OF EMBODIMENTS OF THE INVENTION

Several exemplary embodiments of the claimed invention(s) will now be described with reference to the drawings.

Unless otherwise noted, like elements will be identified by identical numbers throughout all figures. The invention(s) illustratively disclosed herein suitably may be practiced in the absence of any element that is not specifically disclosed herein. The following description is not to be taken in a limiting sense, but is made merely for the purpose of describing the general principles of exemplary embodiments. The scope of the invention(s) should be determined with reference to the claims. Reference throughout this specification to "one embodiment," "an embodiment," or similar language means that a particular feature, structure, or characteristic described in connection with the embodiment is included in at least one embodiment of the inventions disclosed herein. Thus, appearances of the phrases "in one embodiment," "in an embodiment," and similar language throughout this specification may, but do not necessarily, all refer to the same embodiment. Furthermore, the described features, structures, or characteristics of the invention may be combined in any suitable manner in one or more embodiments. In the following description, numerous specific details are provided, such as examples of device structures, methods of use of the devices, etc., to provide a thorough understanding of embodiments of the invention(s). One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention(s).

Novel fascia activation and training devices, and methods of use thereof, are disclosed herein. It should be noted that while the exemplary embodiments of the invention(s) as described herein are primary configured for use with a patient's lower extremities such as feet and legs, the same principles discussed herein could be implemented in fascia activation and training devices, and associated methods of use, that are configured to be used with other parts of a patient's body including, but not limited to, one or more rays of the hands, humerus, ulna, and radius. Indeed, it is contemplated that the fascia activation and training devices, and methods of use taught herein could be utilized to activate and train fascia associated with almost any other member of a patient's body over which he or she has voluntary control of movement. The training devices and methods described herein, combining pressure activation and joint mobilization, and provide numerous advantages over traditional therapy techniques, muscle exercises, and stretching techniques. Specifically, the training devices taught herein provide for faster pain relief and greater remodeling of tissue that is notoriously stiff and hard to loosen, which often results in stiffness, pain, and body members out of alignment. The training devices and associated methods of use taught herein also allow for the release of tendons and muscles, and mobilizes the connective fascia tissue by utilizing combined motions, co-contractions, the closing of the kinetic chain horizontal, and boney contact.

Referring now to FIG. 1, shown is a perspective view of an embodiment of the fascia activation and training device (101) in accordance with aspects of the present disclosure. The reader should note that the words "fascia activation and training device" has in many instances below been shortened to "training device" throughout this disclosure. In one embodiment, the training device includes a collapsible elongate device body (102) having a first end (104) that is positioned opposite the device body to a second end (106). A first end cuff (108) is removably mounted to the first end (104) of the elongate device body (102), and a second end cuff (110) is removably mounted to the second end (106) of the elongate device body (102), and in some embodiments the end cuffs may be mounted to the elongate device body with locking swivel heads (for example, a locking ball and socket joint attachment) to allow the end cuffs to adjust for various angles of use. The openings (109, 111) of the end cuffs are laterally oriented, allowing a user to place the heels of his or her feet into the end cuff from above such as while in a standing position, or through the forward facing openings to the end cuffs. In the context of this disclosure with respect to end cuffs, the term "laterally oriented" shall be interpreted to mean the end cuff openings are generally oriented to face a direction other than inward towards the elongate device body, or outwards away from the elongate device body (see examples of outwardly oriented end cuffs depicted in the embodiment of the training device illustrated in FIGS. 3-4). The end cuffs of alternate embodiments of the training device may be laterally rotated inwardly or outwardly (see FIG. 25) in amounts less than forty-five degrees (as compared to the forward-facing end cuff openings depicted in FIGS. 1-2), while still being deemed to have laterally oriented end cuffs as such term is used herein. In alternate embodiments, the end cuffs may be non-removable. In one embodiment of the training device, the elongate device body (102) may comprise a hollow central body portion (112) having opposing ends with an inner diameter sized to mate with end portions (114, 116), each the end portions having outer diameters smaller than said inner diameter of the opposing ends of the central body portion (112) such that the end portions are capably of sliding in an inwardly and outwardly direction with respect to the central portion. This ability of the end portions (114, 116) within the central portion (112) of the elongate device body (102) provides for the collapsible nature of such device body. In one embodiment, one or more detent holes (118) may be formed on the central body portion (112) as part of one or more detent mechanisms to at least temporarily hold the end portions (114, 116) in a fixed position with respect to the central body portion (see FIG. 25 and associated description thereof). It should be noted that in some alternate embodiments of the training device, the working length of the elongate device body (distance between the first end (104) and second end (106)) is adjustable by a user without the utilization of a detent mechanism (for example, see FIG. 17, which illustrates an alternate embodiment of a training device having a compression spring mounted within the hollow central portion of the elongate body, allowing a user to compress the device body and change the working length of the device body under resistance provided by the spring). It should also be noted that in some other alternate embodiments of the training device, the working length of the elongate device body is not adjustable (in other words, a fixed working length), and the elongate device body is not hollow. Further, while the embodiments of the training devices depicted herein have elongate body portions that are substantially cylindrical in shape with a circular cross-section, alternate embodiments of the training device may utilize elongate device bodies that may have other shapes such as, for example, elongate device bodies that have rectangular or triangular cross-sections.

Figure 13:
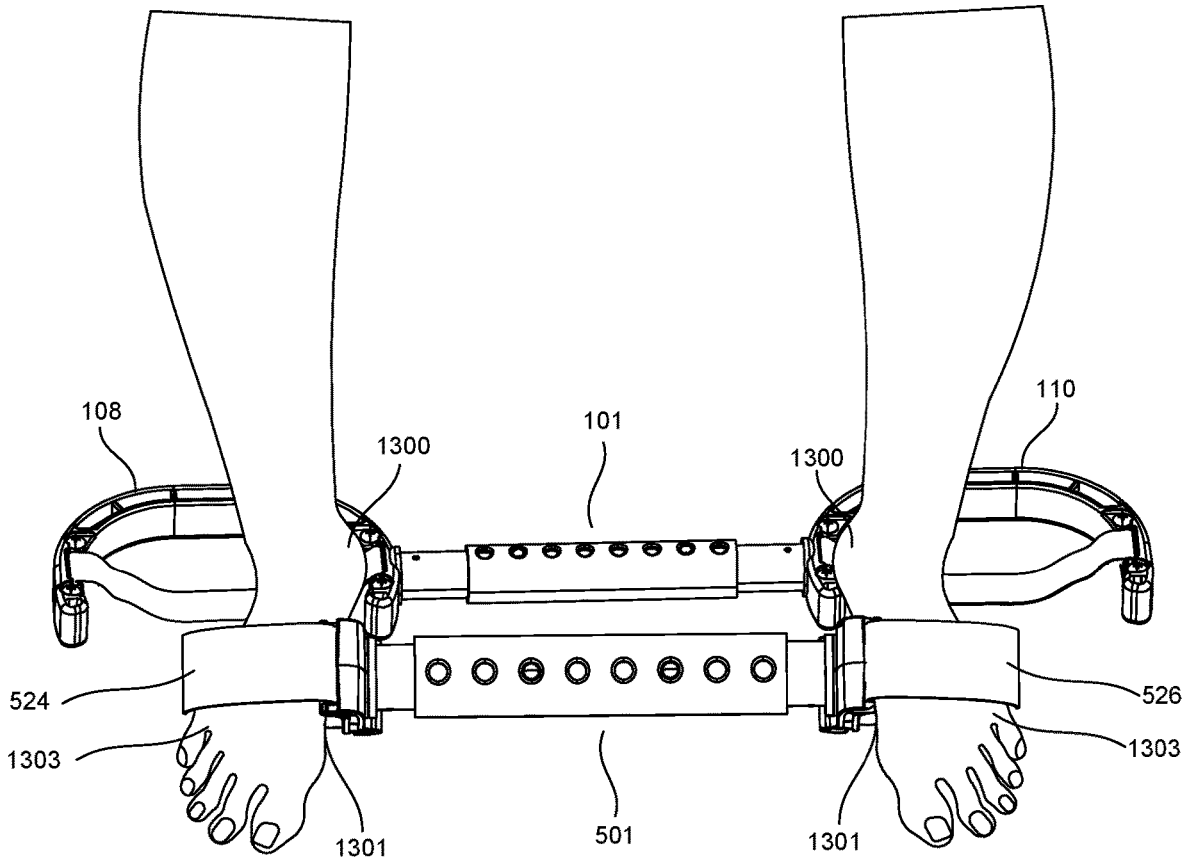
FIG. 13 is an upper perspective view of the alternate embodiments of the fascia activation and training device shown in FIGS. 1-2 and FIGS. 5-6, depicting a user's feet positioned within the end cuffs of the respective devices.
Figure 14:
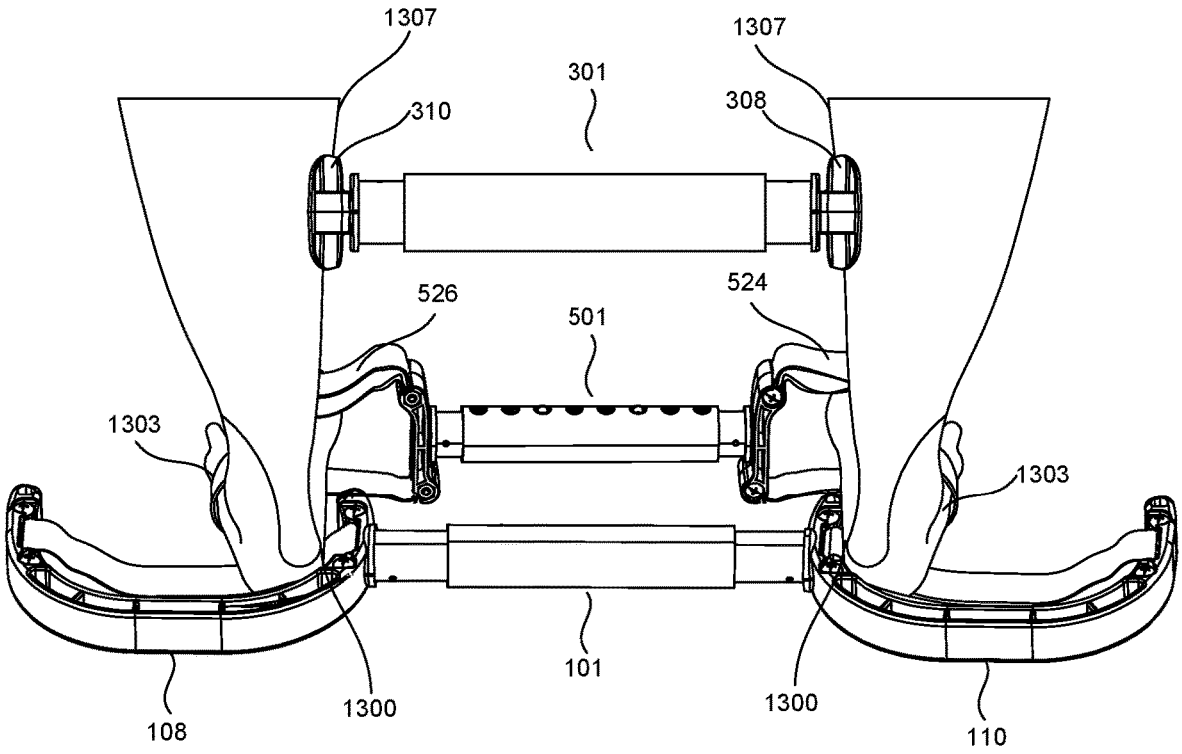
FIG. 14 is an upper perspective view of the alternate embodiments of the fascia activation and training device shown in FIGS. 1-2, FIGS. 3-4, and FIGS. 5-6, depicting a user's feet and legs positioned in the respective devices.
Figure 15:
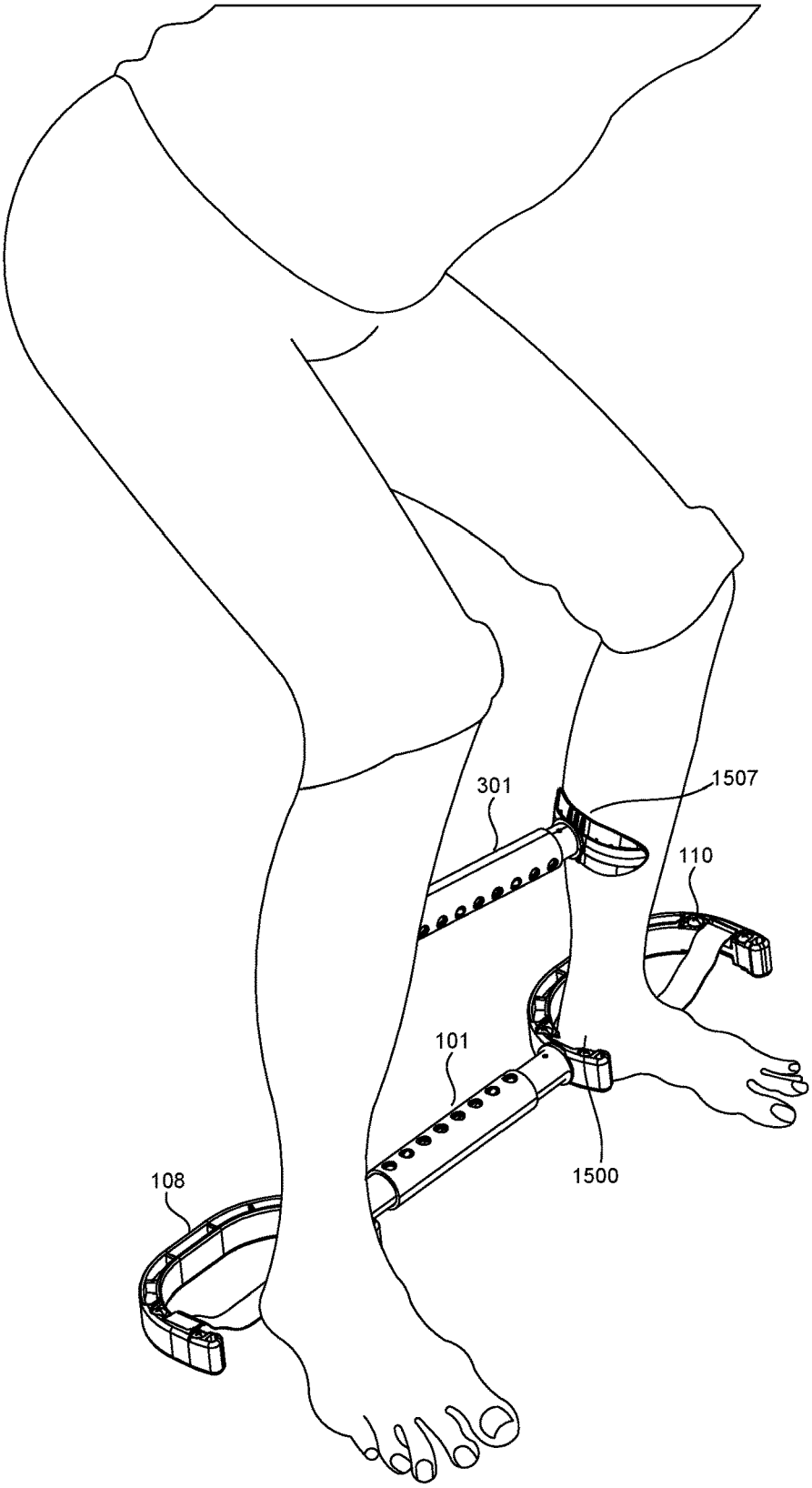
FIG. 15 is an upper perspective view of the alternate embodiments of the fascia activation and training device shown in FIGS. 1-2 and FIGS. 3-4, depicting a user's feet and legs positioned in the respective devices.

Still referring to FIG. 1, in one embodiment of the training device (101), the end cuffs (108, 110) are arcuate "U" shaped members having inside (or "inner") contact surfaces on curved cuff arms (120, 122) lined with a layer of compressible foam (199). In alternate embodiments, the cuff arms may be lined with some other soft material padding, or not lined with any foam or padding. The end cuffs in one embodiment have a generally concave shaped inside curved arm contact surface (120) with a cuff opening. As described in more detail below, the end cuffs, and in particular the inside contact surface of the end cuffs, are shaped and positioned to receive a user's (typically a patient) body members (feet, legs, hands, etc.) to facilitate proper positioning of such body members, and to provide resistance to the movement of such body members, which in turn provides for the activation and training of fascia, and for feedback. Indeed, the arcuate/concave shape of the end cuffs, which in the embodiment of the training device shown in FIG. 1, comprising rigid "U"-shaped members (in some embodiments, "C" shaped end cuffs are utilized), provides a rigid structure upon which a user's body members can compress, both inwardly and outwardly on the cuff arm inside contact surfaces (120, 122) of the end cuffs (108, 110). In the embodiment depicted in FIG. 1, the end cuff opening (gap where no cuff arm is present) is located on the forward portion of the end cuff, the opening providing a passage through which the forward part of a user's foot may project, while the user's heel is generally positioned within the end cuff as illustrated in FIGS. 13-15.

Figure 18:
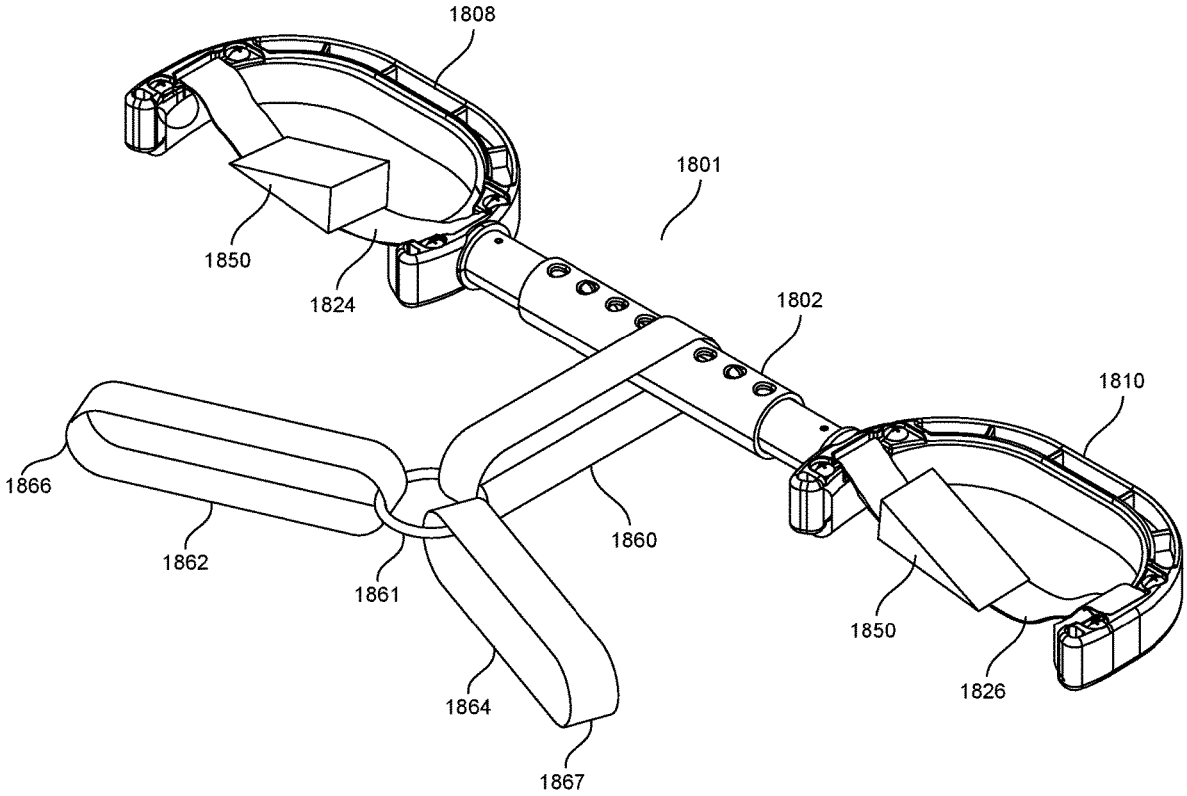
FIG. 18 is an upper perspective view of an alternate embodiment of the fascia activation and training device depicted in FIGS. 1-2.
Figure 19:
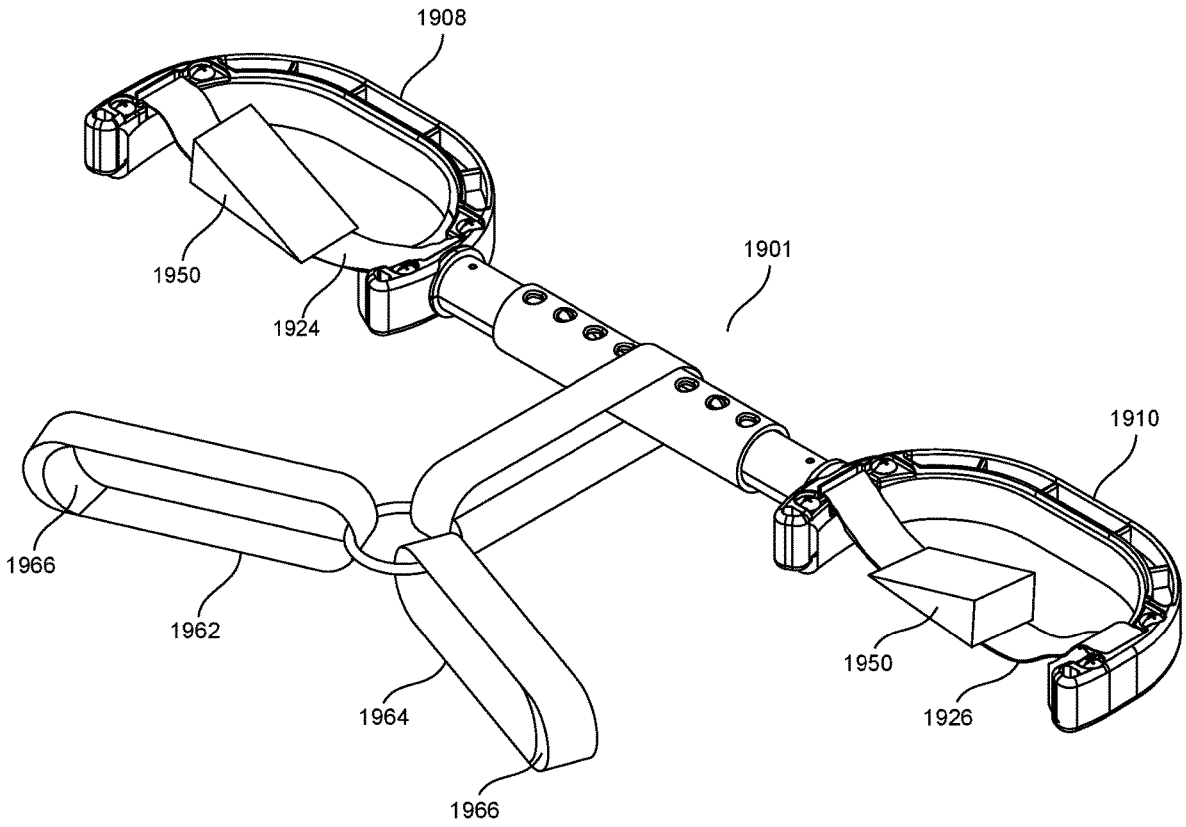
FIG. 19 is an upper perspective view of an alternate embodiment of the fascia activation and training device depicted in FIG. 18.

Still referring to FIG. 1, in one embodiment of the training device (101), one or more flexible straps (124, 126) are attached to the end cuffs (108, 110) such that each strap spans across the inside of the respective end cuff to which it is attached. It is also contemplated that in alternate embodiments, that one or more straps may be attached to the front of the end cuffs such that each strap spans across the front openings of the respective end cuffs. In some embodiments, a strap spanning across the front of the cuff opening may be configured to be placed across the front of a user's ankle. In some alternate embodiments, both sides of a strap may be fixed to opposing sides of an end cuff, but in other alternate embodiments, one or both ends of a strap may be releasably secured to sides of the end cuff via a quick release buckle, one or more hook and loop fasteners, or another means for releasably securing a strap. Straps spanning across the end cuffs, and in front of the end cuff openings, may be utilized in combination for some alternate embodiments of the training device. The straps assist the user in maintaining the proper positioning of the body member placed within the end cuff (for example, see FIG. 13, showing a user's feet positioned on the straps of the end cuffs), and can also aid in securing the training device to the user's body member. In other embodiments, the straps serve as a structure upon which tapered wedge members, and other members used to optimize the positioning of user body members, may be attached (for example, see FIGS. 18-19, showing tapered wedge members attached to the end cuff straps). It should be noted that embodiments of the training device may be constructed using any number of materials having properties that provide for sufficient rigidity such that the structures of the training device will not deform under compressive (inwardly directed forces applied on the training device) or expansive forces (outwardly directed forces applied on the training device) by a user. For example, the components of the training device may be constructed of many types of materials including, but not limited to, metals/alloys (for example, stainless steel), polymers (for example, high density poly ethylene), carbon fiber, and wood (including a combination of the foregoing materials), utilizing any number of manufacturing processes now or later known in the art (casting, stamping, punching, machining, welding, cutting, injection molding, additive manufacturing), and combinations of such manufacturing processes. In one embodiment, disclosed is a training device (101) comprising: an elongate device body (102) having a first end (104) and a second end (106); a first cuff (108) attached to said first end of said elongate device body; and a second cuff (110) attached to said second end of said elongate device body, wherein each of said first cuff and said second cuff have a curved arm (120, 122), wherein each of said first cuff and said second cuff is sized to receive a body member of a device user (see FIG. 8 at 800). In one embodiment, a first strap (124) is attached to a first side of said first end cuff and a second opposing side of said first end cuff, and wherein a second strap (126) is attached to a first side of said second end cuff and a second opposing side of said second end cuff.

Figure 2:
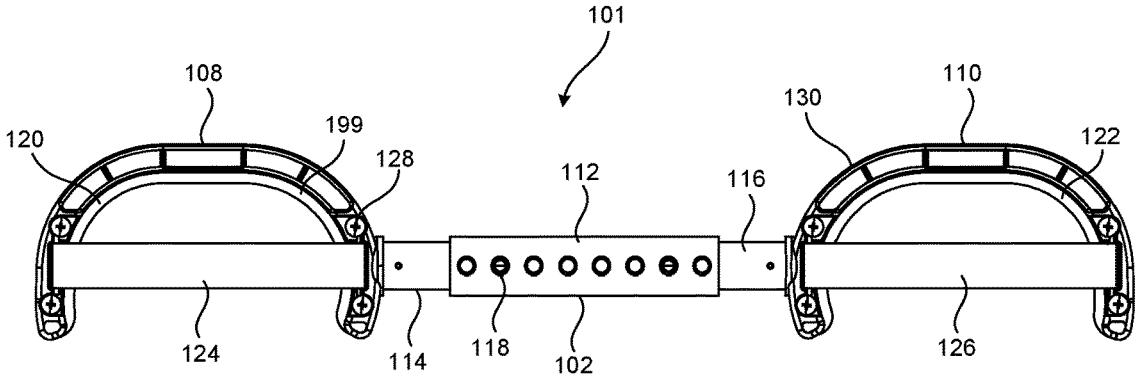
FIG. 2 is a top view of the embodiment of the fascia activation and training device depicted in FIG. 1.

Referring now to FIG. 2, shown is a top view of the embodiment of the fascia activation and training device (101) depicted in FIG. 1. In one embodiment, the cuff arm inner contact surfaces of the end cuffs (108, 110) may be lined with compression foam (199) to provide a comfortable surface for a user's body member and in some instances, to facilitate the user's application of force on such contact surfaces. Further, in one embodiment of the training device, one or more fasteners (128) may be utilized to attach the straps (124, 126) to the respective end cuffs (108, 110). Such fasteners may include, as one example, threaded screws configured to secure a pin (not shown) holding the strap securely to the end cuff, sized to engage with correspondingly threaded holes forms in said end cuffs. However, it should be noted that other types of fastening mechanisms (hook and loop fasteners, quick release buckles, button snaps, etc.), and other types of ways of attaching the straps to the end cuffs (including adhesives) may be utilized in alternate embodiments of the training device. The straps (124, 126) may in some embodiments have a fixed length such as shown in FIG. 2, or alternatively have an adjustable length in alternate embodiments. Indeed, in some embodiments of the training device, such as the embodiment shown in FIGS. 5-6, at least a portion of the end cuffs may comprise an adjustable strap portion attached to a rigid portion of the end cuff. In other embodiments, the end cuffs may be arcuate or concave in shape, such that the portion of the end cuff configured to receive the user's body member is generally concave in shape, but may take an arched form dissimilar from the "U"-shaped shape of the end cuffs shown in FIGS. 1-2. In some alternate embodiments, only the inside contact surfaces of the end cuffs are arcuate in shape, while the outside surfaces (130) of the end cuffs may not be arcuate in shape, but may indeed have all manner of different shapes. Further, the proportions and dimensions of the end cuffs in various alternate embodiments may vary from those generally depicted herein, depending on the size and type of body member to be used in connection with a embodiment of a particular training device. In other alternate embodiments of the training device, the inside contact surfaces of the end cuffs may have non-arcuate shapes. In other alternate embodiments of the training device, the cuff arms may be constructed to have a shape conforming to a user's body members on which the training device is intended for use. For example, in some alternate embodiments of the training device, the end cuffs may be constructed to have contact surfaces that are contoured to correspond to the contours of a user's feet or other body members. In other alternate embodiments of the training device, the inside contact surfaces of the end cuffs may be a rectangular in shape, with one side of the end cuff open. Regardless of the type of end cuff utilized on the training device, the end cuffs of the training device provide a user with structures upon which inwardly and outwardly directed forces may be applied by a user's body members to enhance the activation of fascia, and to provide the user with biomechanical feedback when practicing the methods of use described further below.

Figure 3:
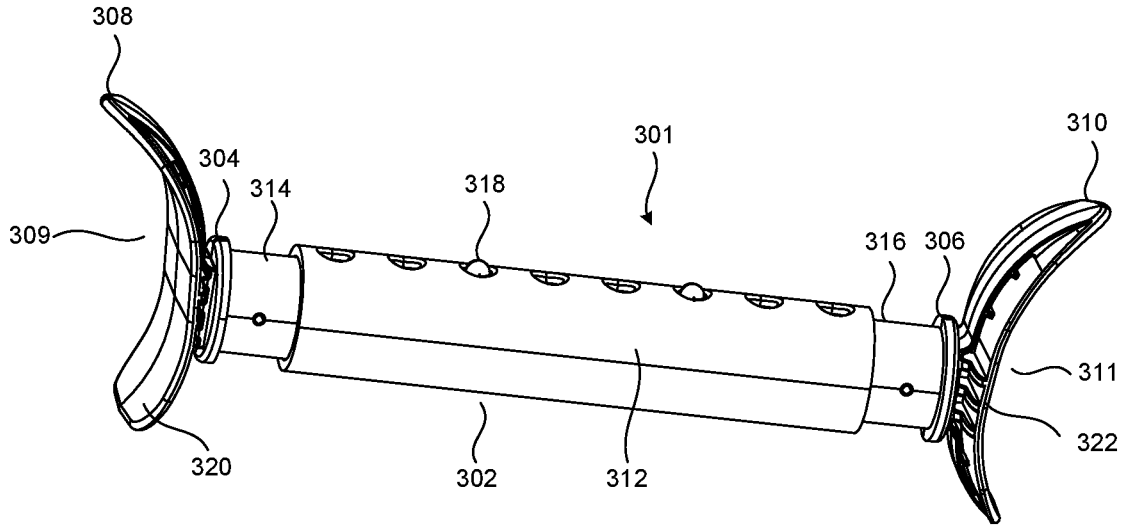
FIG. 3 is a perspective view of an alternate embodiment of the fascia activation and training device in accordance with aspects of the present disclosure.

Referring now to FIG. 3, shown is a perspective view of an alternate embodiment of the fascia activation and training device in accordance with aspects of the present disclosure. In many respects, this alternate embodiment of training device is similar to the embodiment of the training device depicted in FIGS. 1-2. Namely, the alternate embodiment of the training device includes a collapsible elongate device body (302) having a first end (304) that is positioned opposite the device body to a second end (306), the distance between such first and second ends defining a working length. A first end cuff (308) is removably mounted to the first end (304) of the elongate device body (302), and a second end cuff (310) is removably mounted to the second end (306) of the elongate device body (302). In alternate embodiments, the end cuffs may be non-removable. Indeed, other than the particular shape, orientation, and structure of the end cuffs of the alternate embodiment of the training device depicted in FIGS. 3-4, the alternate embodiment is in all other ways the same as the embodiment shown in FIGS. 1-2, with the explanations set forth above regarding possible alternate embodiments being equally applicable to all embodiments of the training device taught herein.

Figure 12:
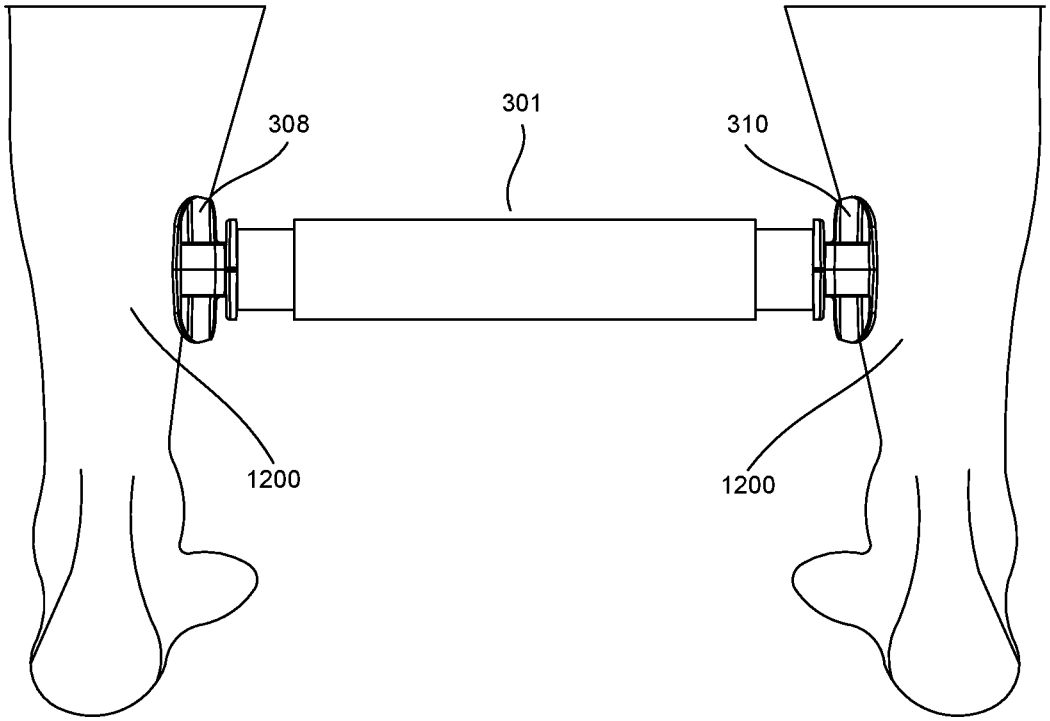
FIG. 12 is a perspective view of the alternate embodiment of the fascia activation and training device shown in FIG. 3 and FIG. 4, depicting the device positioned between a user's legs

Still referring to FIG. 3, the end cuffs (308, 310) of the alternate embodiment of the training device have curved (concave in the embodiment shown) cuff arms (320, 322) with cuff openings (309, 311) that are outwardly oriented. In the context of this disclosure with respect to end cuffs, the term "outwardly oriented" shall be interpreted to mean an end cuff opening generally facing away from the elongate device body. The outwardly oriented end cuff opening of the embodiment of the training device depicted in FIG. 3 facilitates the placement of the training device between body members such as, for example, legs, of a user of the training device (for example, see FIG. 12, illustrating the placement of the alternate embodiment of the training device placed between the legs of a user to enhance the activation of fascia).

Figure 4:
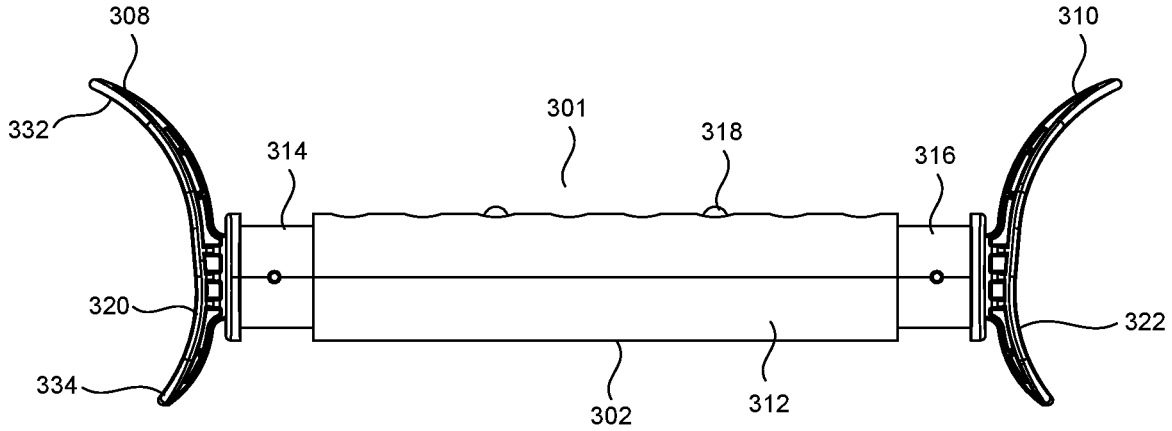
FIG. 4 is a side view of the alternate embodiment of the fascia activation and training device depicted in FIG. 3.

Referring now to FIG. 4, shown is a side view of the alternate embodiment of the fascia activation and training device depicted in FIG. 3. In some alternate embodiments of the training device, one side of a contact surface of an end cuff may be larger/longer than the other side of the contact surface of the same end cuff. For example, in the alternate embodiments of the training device depicted in FIGS. 3-4, an upper cuff arm contact surface (332) is larger/longer (extends a greater distance from the end (314) as compared to a lower cuff arm contact surface (334) on the same end cuff). This difference in lengths of the contact surfaces provides for more optimal positioning of the user's body members in some circumstances, and an ability to more specifically focus on certain points of fascial activation.

Figure 5:
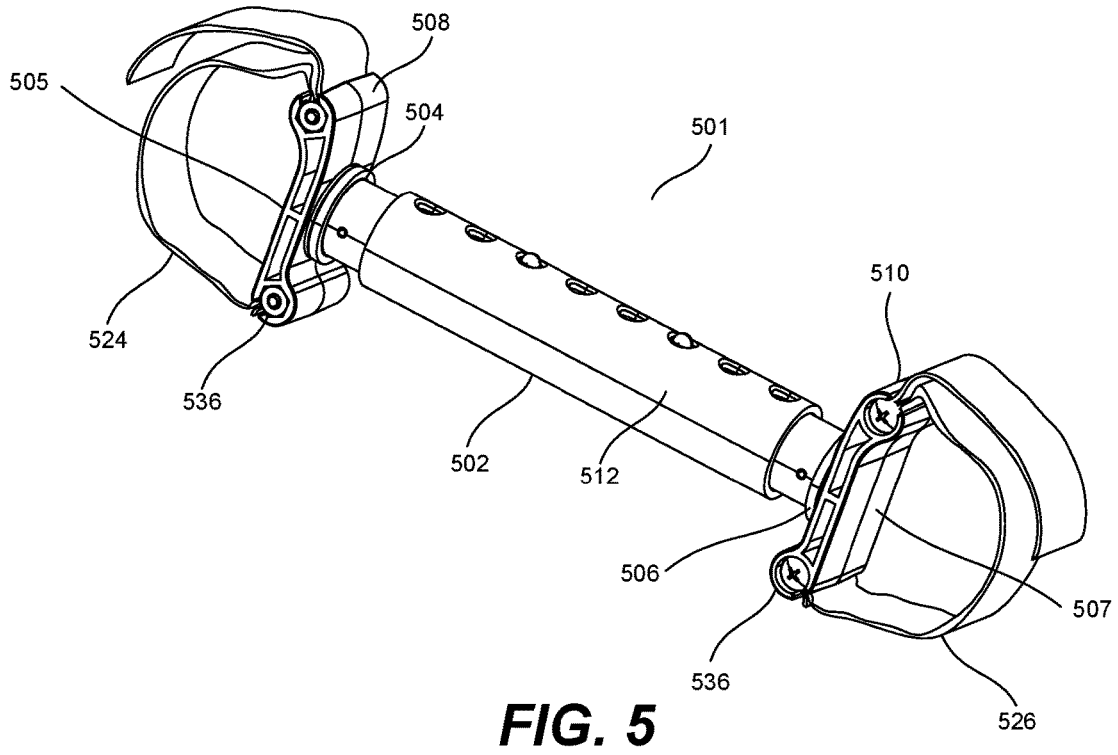
FIG. 5 is a perspective view of a further alternate embodiment of the fascia activation and training device in accordance with aspects of the present disclosure.

Referring now to FIG. 5, shown is a perspective view of a further alternate embodiment of the fascia activation and training device (501) in accordance with aspects of the present disclosure. In many respects, this alternate embodiment of training device is similar to the embodiment of the training device depicted in FIGS. 1-2 and FIGS. 3-4. Namely, the alternate embodiment of the training device includes a collapsible elongate device body (502) having a first end (504) that is positioned opposite the device body to a second end (506), the distance between such first and second ends defining a working length. A first end cuff (508) is removably mounted to the first end (504) of the elongate device body (502), and a second end cuff (510) is removably mounted to the second end (506) of the elongate device body (502). In alternate embodiments, the end cuffs may be non-removable. Indeed, other than the particular shape, orientation, and structure of the end cuffs of the alternate embodiment of the training device depicted in FIGS. 5-6, the alternate embodiment is in all other ways the same as the embodiment shown in FIGS. 1-2, with the explanations set forth above regarding possible alternate embodiments being equally applicable to all embodiments of the training device taught herein.

Figure 11:
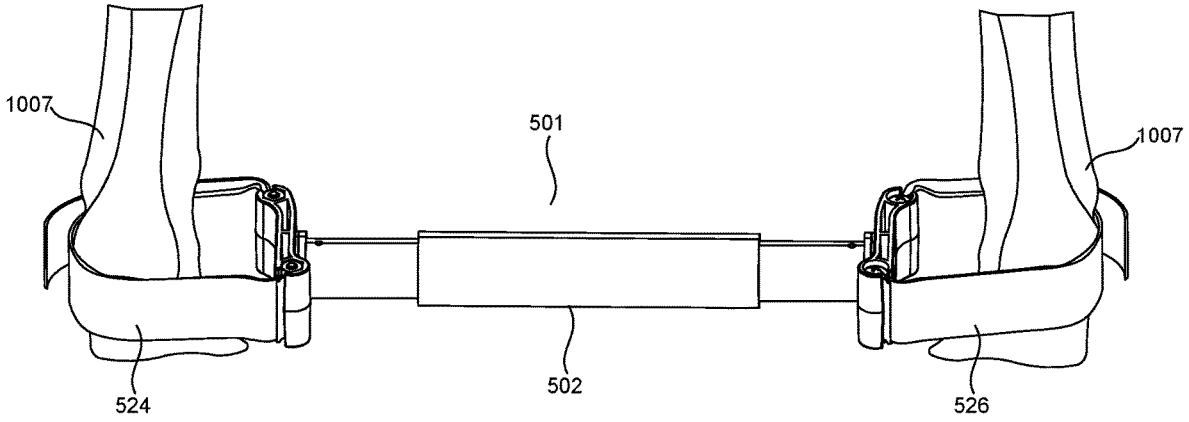
FIG. 11 is a further upper perspective view of the alternate embodiment of the fascia activation and training device shown in FIG. 5, FIG. 6, and FIG. 10, depicting a user's feet positioned within the end cuffs of the device.

Still referring to FIG. 5, the end cuffs (508, 510) of the alternate embodiment of the training device have end cuffs that are closed, with adjustable straps (524, 526) serving as the outer structures of the end cuffs—namely, as curved cuff arms. In one embodiment as depicted in FIG. 5, the straps are adjustably attached to a rigid portion (505, 507) of each end cuff at one or more attachment points (536). The adjustable straps (524, 526) are configured to allow the end cuffs to be secured to a user's body members (for example, see FIG. 11, depicted the training device secured to a user's feet). The rigid portion of the end cuff provides a structure against which a user may compress his or her body members inwardly, while the straps provide a structure which are capable of bearing outwardly directed forces of a user's body members when used to activate fascia. This ability of the training device to bear both inwardly directed and outwardly directed forces applied by a user through their respective body members is one advantage not seen in prior art training devices.

Figure 6:
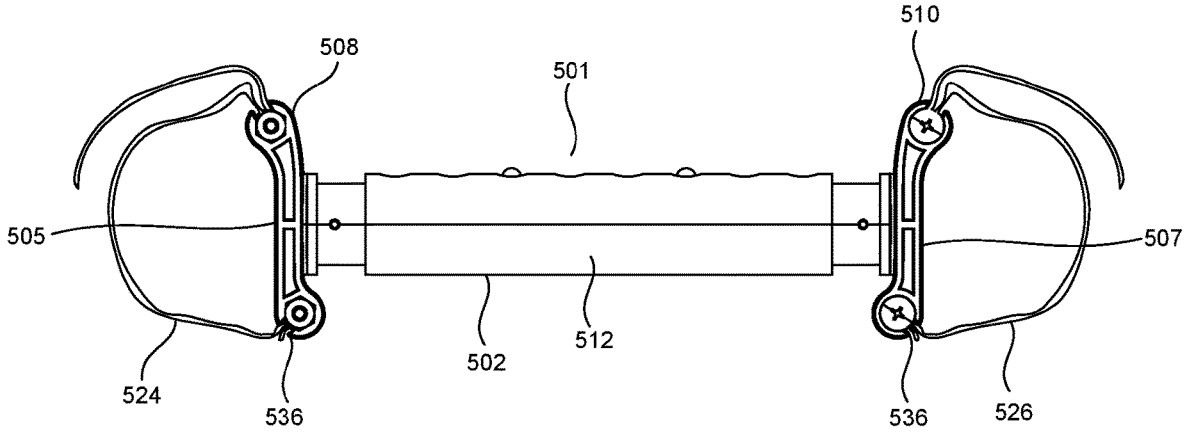
FIG. 6 is a side view of the alternate embodiment of the fascia activation and training device depicted in FIG. 5.

Referring now to FIG. 6, shown is a side view of the alternate embodiment of the fascia activation and training device depicted in FIG. 5. It should be noted that alternate embodiments of the training device utilizing adjustable straps of the type described herein, may be used in conjunction with rigid portions of the end cuffs having a multitude of various shapes and sizes other than that which is depicted in FIGS. 5-6. Indeed, in some alternate embodiments the rigid portion of the end cuffs may be more linear or arcuate/concave in shape than what is shown in FIGS. 5-6. In some alternate embodiments, the straps (524, 526) may include a foam liner or other soft padding attached to all or a portion of the inside of the straps that comes into contact with a user's body member, thereby enhancing the comfort level when a user's body members are attached to the training device. In some alternate embodiments, a side release buckle or other type of quick release buckle may be connected to each strap to facilitate securing and releasing the strap to a user's body member.

Figure 7:
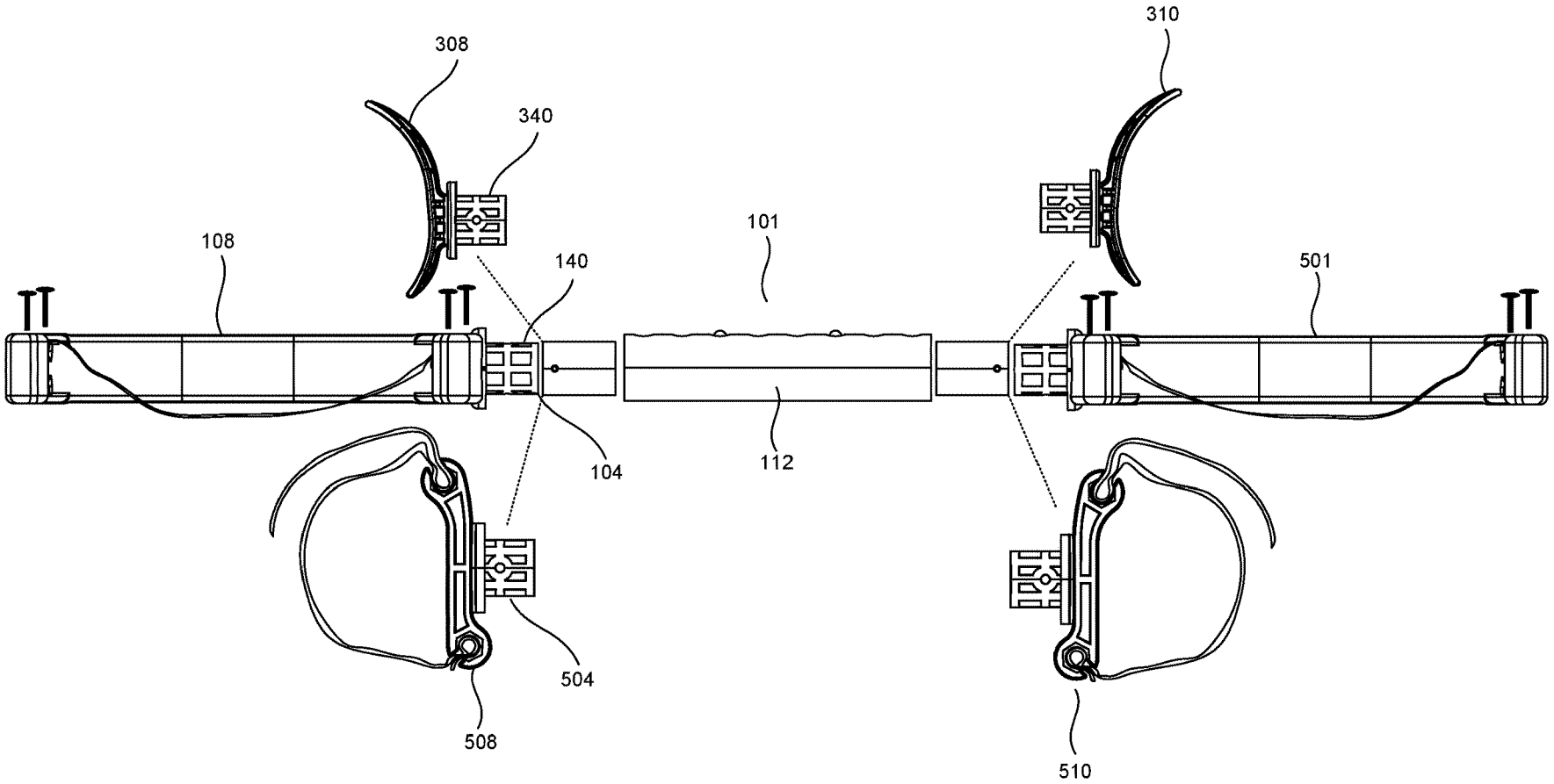
FIG. 7 is an exploded side view of the embodiment of the fascia activation and training device depicted in FIG. 1, and further depicting the interchangeable nature of the removable end cuffs of the alternate embodiments of the fascia activation and training devices depicted in FIGS. 3-6.

Referring now to FIG. 7, shown is an exploded side view of the embodiment of the fascia activation and training device depicted in FIG. 1, and further depicting the interchangeable nature of the removable arcuate end cuffs of the alternate embodiments of the fascia activation and training devices depicted in FIGS. 3-6. In embodiments of the training device having removable end cuffs, different types of end cuffs may be interchangeable with the elongate device body. In some embodiments, an inwardly directed protrusion (140, 340, 540) is formed on the inward side (side most adjacent the respective ends (104, 106) of the end portions (114, 116) of the elongate body device (102)) of the end cuffs. Such protrusions are sized to be received in the respective ends (104, 106), and in some embodiments are at least temporarily locked into place within said ends (104, 106) to prevent them from inadvertently being displaced during use of the training device. The removable end cuffs may be removed from the ends (104, 106) and other types of end cuffs may be inserted in their place, thus providing a user with the ability to mix-and-match end cuffs with an elongate device body to suit different types of fascial activation on different body members.

The training devices and methods of use described herein provide numerous advantages to users as compared to traditional muscle and stretching exercises. There is a torque conversion that happens throughout the entire body naturally, such as when a person moves, walks, or changes direction. When the forces and torques to which the human body is subjected to do not get communicated throughout the body, the breakdown of joints can occur. The inwardly and outwardly directed forces that the training devices taught herein facilitate train the user's fascia to optimize torque change and kinematic force through the body, and shears fascia free from excessive stiffness against boney structures, which will further result in the advantageous growth of additional sites that secrete more lubrication.

Figure 8:
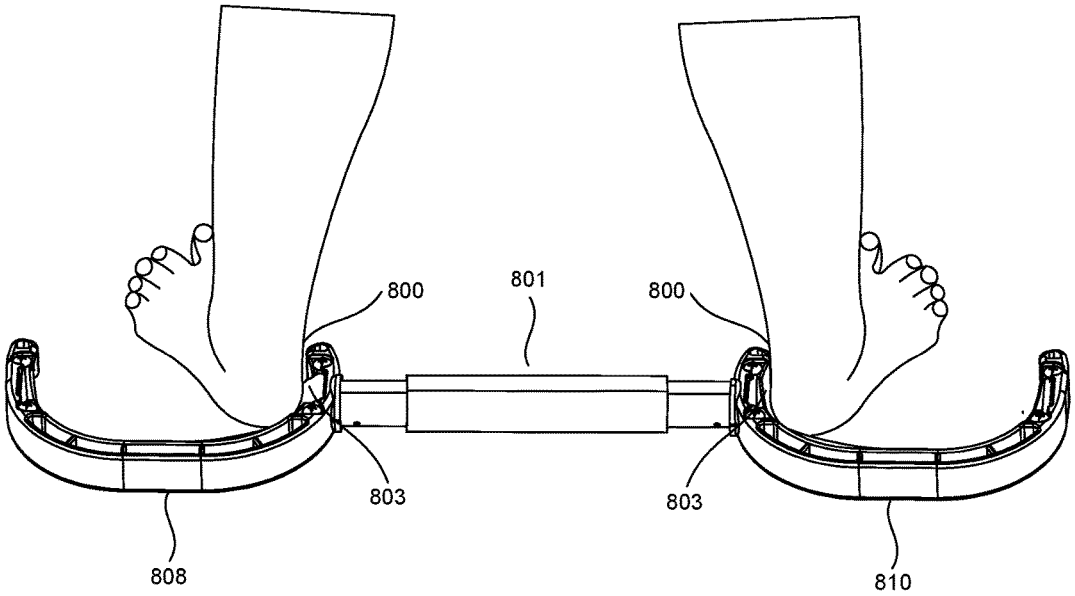
FIG. 8 is an upper perspective view of a further alternate embodiment of the fascia activation and training device in accordance with aspects of the present disclosure, depicting a user's heels positioned within the end cuffs of the device.

Referring now to FIG. 8, shown is an upper perspective view of a further alternate embodiment of the fascia activation and training device (801) in accordance with aspects of the present disclosure, depicting a user's heels (800) positioned within the end cuffs of the device. The embodiment of the training device depicted in FIG. 8 is in almost all respects identical to the embodiment of the training device depicted in FIGS. 1-2, with the exception that the straps spanning across the end cuffs are absent. The training device is configured to facilitate the placement of a user's heels within the end cuffs due to the lateral orientation of the openings of the end cuffs. Thus, a user may step into end cuffs from a standing position, placing inner portions of the heels (800) within the end cuffs so that they abut inner contact surfaces (803) of the respective end cuffs (808, 810). This allows a user to engage in compression of the heels against the elongate device body. Thus, the training device provides a "hard stop" with pressure resistance against the device to properly and most effectively immobilize a bone while mobilizing the adjacent muscle and connective tissue connecting the structures, creating a shearing force through the body's aponeurosis.

Figure 9:
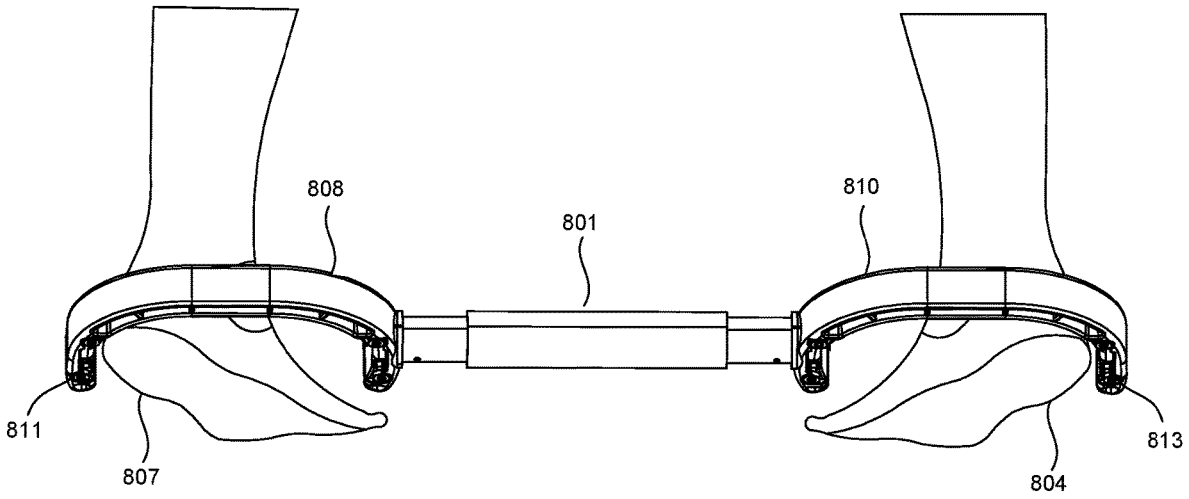
FIG. 9 is a lower perspective view of the alternate embodiment of the fascia activation and training device shown in FIG. 8, depicting a user's heels positioned within the end cuffs of the device.

Referring now to FIG. 9, shown is a lower perspective view of the alternate embodiment of the fascia activation and training device illustrated in FIG. 8, depicting a user's heels (807) positioned within the end cuffs of the device. A user may step into end cuffs from a standing position, placing outer portions of the heels (807) within the end cuffs so that they abut outer contact surfaces (811) of the respective end cuffs (808, 810). This allows a user to engage in directing their heels outward, away from the elongate device body, to further activate fascia and provide biomechanical feedback to the user.

Figure 10:
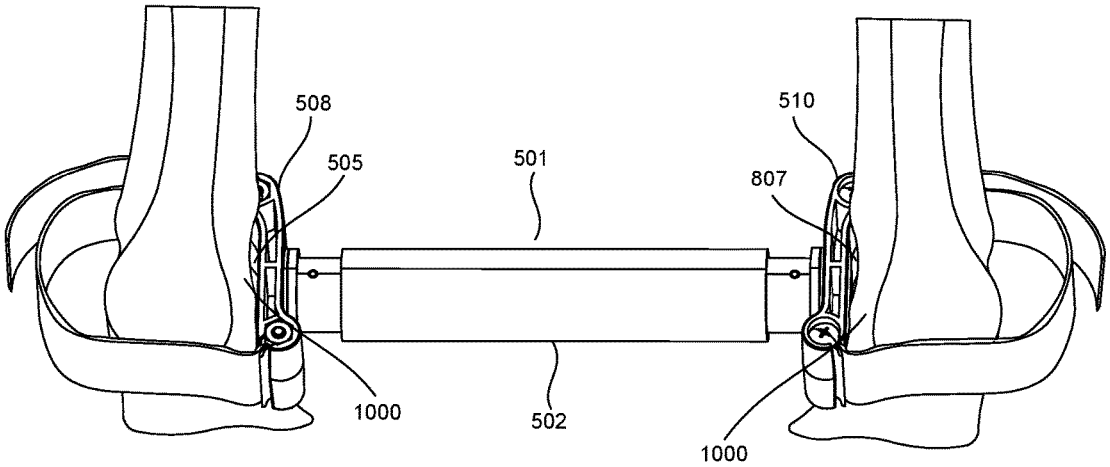
FIG. 10 is an upper perspective view of the alternate embodiment of the fascia activation and training device shown in FIG. 5 and FIG. 6, depicting a user's feet positioned within the end cuffs of the device.

Referring now to FIG. 10, shown is an upper perspective view of the alternate embodiment of the fascia activation and training device illustrated in FIG. 5 and FIG. 6, depicting a user's feet positioned within the end cuffs of the device, and applying an inwardly directed force on both end cuffs of the training device. The training device is configured to facilitate the placement of a user's feet within the end cuffs, the length of the straps being adjustable to accommodate variables in the size of a user's feet or other body member to be placed within end cuffs. Thus, a user may place inner portions of the feet (900) within the end cuffs so that they abut the rigid contact surfaces (505, 507) of the respective end cuffs (508, 510). This allows a user to engage in compression of the middle foot against the rigid portion of the end cuffs. Thus, the training device provides a "hard stop" with pressure resistance against the device to properly and most effectively immobilize a bone while mobilizing the adjacent muscle and connective tissue connecting the structures, creating a shearing force through the body's aponeurosis.

Referring now to FIG. 11, shown is a further upper perspective view of the alternate embodiment of the fascia activation and training device shown in FIG. 5, FIG. 6, and FIG. 10, depicting a user's feet positioned within the end cuffs of the device, and applying an outwardly directed force on both end cuffs of the training device. A user may place their feet into the end cuffs, placing the outer portions of the middle portion of their feet (1007) within the end cuffs so that they abut the straps (524, 526) of the respective end cuffs (508, 510). This allows a user to engage in directing their feet outward, and continuously pressing outward away from the elongate device body, to further activate fascia and provide biomechanical feedback to the user.

Referring now to FIG. 12, shown is a perspective view of the alternate embodiment of the fascia activation and training device illustrated in FIG. 3 and FIG. 4, depicting the device positioned between a user's legs. In accordance with at least one method of using the training device, described in more detail below, a user may place the training device (301) between his or her legs (1200) adjacent to the tibia bones. A user may be directed to press both tibia bones inwardly through the curved arm contact surfaces of the end cuffs into a hard stop (maximum inward compression of training device achieved), then continue pushing inwardly inconsistently, and slowly perform ankle plantarflexion and dorsiflexion. As described above, the elongate device body may be adjustable in length to accommodate different users having variable shoulder and hip-widths, to use the training device to train common weightlifting stances and motions.

Referring now to FIG. 13, shown is an upper perspective view of the alternate embodiments of the fascia activation and training device illustrated in FIGS. 1-2 and FIGS. 5-6, depicting a user's feet positioned within the end cuffs of the respective devices. A user has compressed the inner portions of their heels (1300) inwardly into the curved arm inner contact surfaces of the end cuffs (108, 110) of the embodiment of the training device (101) depicted in FIGS. 1-2. The user has simultaneously placed their feet inside the straps (524, 526) of the end cuffs of the embodiment of the training device (501) depicted in FIGS. 5-6, flexing their feet outwardly against the straps (524, 526). Utilizing multiple training devices in the manner depicted in FIG. 13 enhances the fascial activation effect. This is performed by crossing at least one joint before incorporating an additional training device, and the user pressing against the second training device in an opposite direction. The combination of utilizing multiple training devices, which allow for both inwardly directed compression and outwardly directed compression, simultaneously by a user, constitutes a training system having advantages discussed herein not realized in the prior art.

Referring now to FIG. 14, shown is an upper perspective view of the alternate embodiments of the fascia activation and training device illustrated in FIGS. 1-2, FIGS. 3-4, and FIGS. 5-6, depicting a user's feet and legs positioned in the respective devices. Together, such use of multiple training devices by a user simultaneously, constitutes a training system. A user has compressed the inner portions of their heels (1300) inwardly into the inner contact surfaces of the end cuffs (108, 110) of the embodiment of the training device (101) depicted in FIGS. 1-2. The user has simultaneously placed their feet inside the straps (524, 526) of the end cuffs of the embodiment of the training device (501) depicted in FIGS. 5-6, flexing their feet outwardly against the straps (524, 526). The user has simultaneously placed the embodiment of the training device (301) in FIGS. 3-4, between his or her legs, inwardly squeezing the training device. Utilizing multiple training devices in the manner depicted in FIG. 14, a training system, enhances the fascial activation effect. Using two or three training devices together enhances the fascial activation effect. This is performed by crossing at least one joint using a first training device before applying the next training device, and the user pressing in the same or opposite direction with respect to the multiple training devices as depicted in FIG. 14. The training devices herein may further utilize arrows, markings, and colors displayed on the training devices to indicate proper positioning for users and therapists.

Referring now to FIG. 15, shown is an upper perspective view of the alternate embodiments of the fascia activation and training device illustrated in FIGS. 1-2 and FIGS. 3-4, depicting a user's feet and legs positioned in the respective devices. A user has compressed the inner portions of their heels (1500) inwardly into the inner contact surfaces of the end cuffs (108, 110) of the embodiment of the training device (101) depicted in FIGS. 1-2. The user has simultaneously placed the embodiment of the training device (301) depicted in FIGS. 3-4, between his or her legs, inwardly squeezing the training device. Utilizing multiple training devices in the manner depicted in FIG. 15 enhances the fascial activation effect. The training devices taught herein can be used in a multitude of ways, including sitting, standing, and laying. The training devices can be utilized while pressing body members in a wall or floor, or free-floating in the air. Moreover, use of the training device to perform isometric contractions can be performed simultaneously with practicing stances of various forms of weight-lifting exercises.

Figure 16:
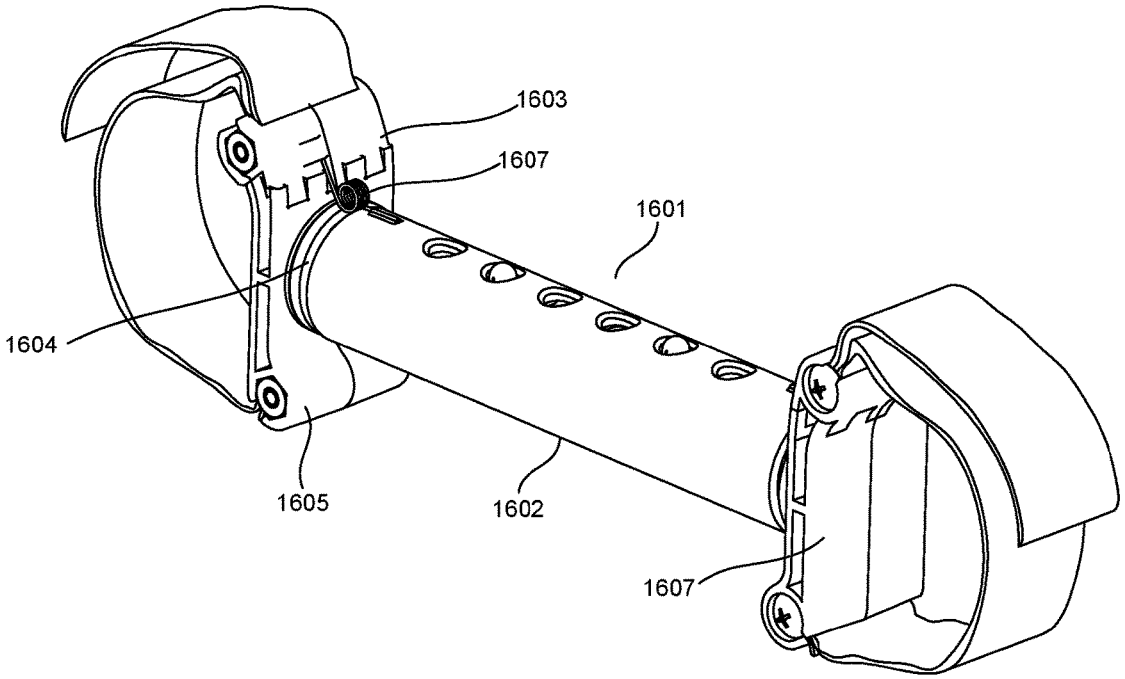
FIG. 16 is an upper perspective view of a further alternate embodiment of the fascia activation and training device in accordance with aspects of the present disclosure, said alternate embodiment having an end cuff capable of pivoting about a torsion spring.

Referring now to FIG. 16, shown is an upper perspective view of a further alternate embodiment of the fascia activation and training device in accordance with aspects of the present disclosure, said alternate embodiment having an end cuff capable of pivoting/rotating about a hinge (1603). In one embodiment, each end cuff (1605) is hingedly attached to the respective ends of the rigid surface of the end cuffs such that each end cuff is capable of pivoting about such hinge (1603) to allow the end cuff to rotate. In other embodiments, one or both end cuffs may be hingedly attached to the respective ends of the elongate device body. A torsion spring (1607) attached to each end of the elongate device body and the end cuff, provides rotational resistance to such pivoting movement of the end cuff. Thus, when a user's body member (such as feet) is placed within the end cuffs, spring resistance is provided in opposition to inward compression movements of the user's body members.

Figure 17:
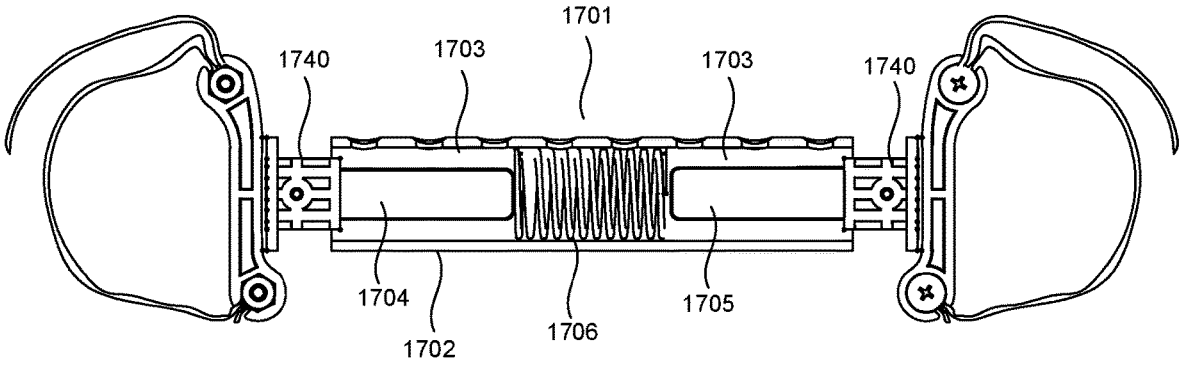
FIG. 17 is a side cutaway view of a further alternate embodiment of the fascia activation and training device in accordance with aspects of the present disclosure, said alternate embodiment having a compression spring mounted within the collapsible elongate device body to resist inward compression of said body.

Referring now to FIG. 17, shown is a side cutaway view of a further alternate embodiment of the fascia activation and training device in accordance with aspects of the present disclosure, said alternate embodiment having a compression spring (1706) mounted within the collapsible elongate device body to resist inward compression of said body. In one alternate embodiment as depicted, inwardly projecting protrusions (1740) of the end cuffs have extended stop members (1704, 1705) that project inside a cavity (1703) of the hollow elongate device body (1702) having a compression spring (1706) mounted therein. The training device is configured to allow for the inward compression of the end cuffs until the inwardly directed force cannot overcome the outwardly directed spring force, or the stop members abut one another inside the hollow elongate device body, providing a hard stop to inward compression. In other alternate embodiments of the training device, one or more vibration motors or circuits may be mounted onto or within the training device, and attached to a power source (for example, a battery) and switch, giving the training device the ability to vibrate, which can facilitate fascial activation and training. Likewise, in other alternate embodiments, one or more electric heating elements may be mounted onto or within the training device, and attached to a power source and switch, giving the training device the ability to be heated, which can also facilitate fascial activation and training. In one embodiment, as noted above, a first inwardly projecting protrusion (1704) is formed on said first end cuff (1740), and a second inwardly projecting protrusion (1705) is formed on a second end cuff (1740), wherein said first inwardly projecting protrusion and said second inwardly projecting protrusion project inwardly inside said elongate device body.

Referring now to FIG. 18, shown is an upper perspective view of an alternate embodiment of the fascia activation and training device depicted in FIGS. 1-2. The embodiment of the training device depicted in FIG. 18 is in almost all respects identical to the embodiment of the training device depicted in FIGS. 1-2, with the addition of tapered wedges (1850) removably attached to the tops of straps (1824, 1826) spanning across the end cuffs. In one embodiment, the tapered wedges may be constructed on high density compression foam and removably attached to the top sides of respective straps. In the embodiment of the training device depicted in FIG. 18, the thicker portion of the tapered wedges is oriented closer to the inward side of the cuff arm contact surfaces of the end cuffs to facilitate the outward rolling of the user's feet as depicted in FIG. 21. In one embodiment, the training device (1801) further comprises a "Y" configured toe strap having a central strap portion (1860) attached to a ring (1861) of other connection point, which is in turn attached to two secondary outwardly extending straps (1862, 1864) having loop ends each configured to be secured to the big toes of a user. In one embodiment, the training device comprises a first tapered wedge (1850) attached to a top side of said first strap (1824), and a second tapered wedge (1850) attached to a top side of said second strap (1826). Further, in one embodiment, the first tapered wedge attached to said top side of said first strap via first hook and loop fasteners, and the said second tapered wedge attached to said top side of said second strap via second hook and loop fasteners. Further, in one embodiment, a first central strap (1860) is attached to the elongate device body (1802), and two secondary straps (1862, 1864) are attached to the first central strap, wherein ends of said two secondary straps have loops (1866, 1867) formed thereon, each of said loops configured to receive a big toe (see FIG. 20 at 2002) of a user of the training device. The tapered wedges may be positioned generally centrally on the straps as depicted in FIG. 18, but in other embodiments may be positioned closer to one side of the end cuff or the other. Also, the width, length, and height of the tapered wedges may vary considerably from embodiment to embodiment, depending on the desired positioning of the body member, the type of body member to be trained, and the type of material used to construct the tapered wedges.

Figure 22:
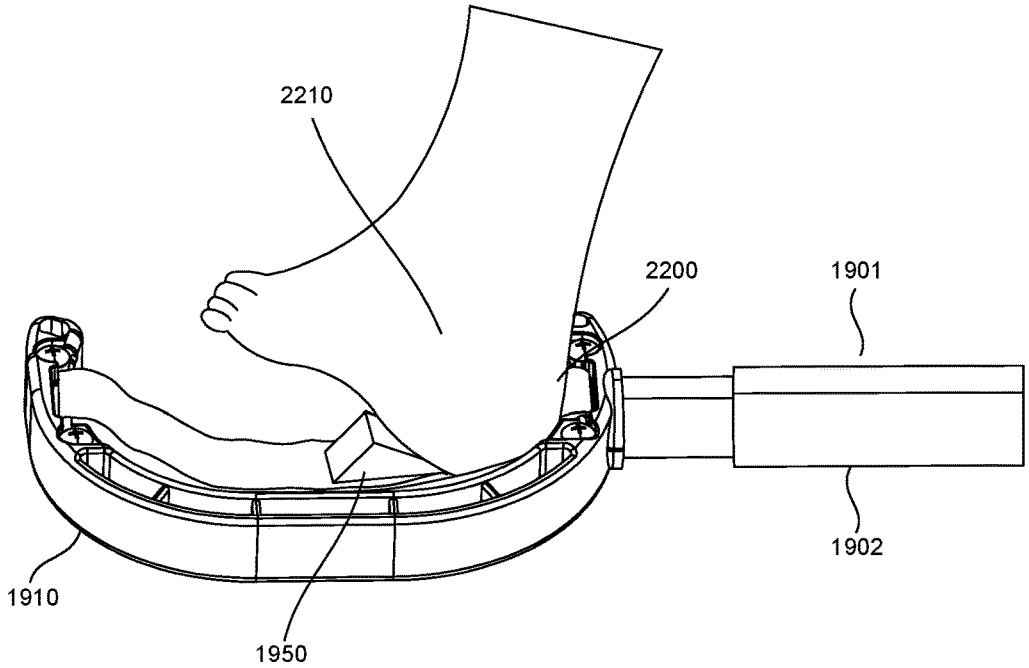
FIG. 22 is a partial perspective view of an end cuff of the alternate embodiment of the fascia activation and training device depicted in FIG. 19, depicting a user's foot positioned within said end cuff.

Referring now to FIG. 19, shown is an upper perspective view of an alternate embodiment of the fascia activation and training device depicted in FIG. 18. In this embodiment of the training device (1901), the thicker portion of the tapered wedges (1950) is oriented closer to the outer side of the contact surfaces of the end cuffs (1908, 1910) to facilitate the inward rolling of the user's feet as depicted in FIG. 22. In this embodiment, the inner surfaces of the loops of the secondary toe straps (1962, 1964) are lined with foam (1966) to provide greater comfort to a user when applying an outwardly directed force to their big toes inserted into such toe straps.

Figure 20:
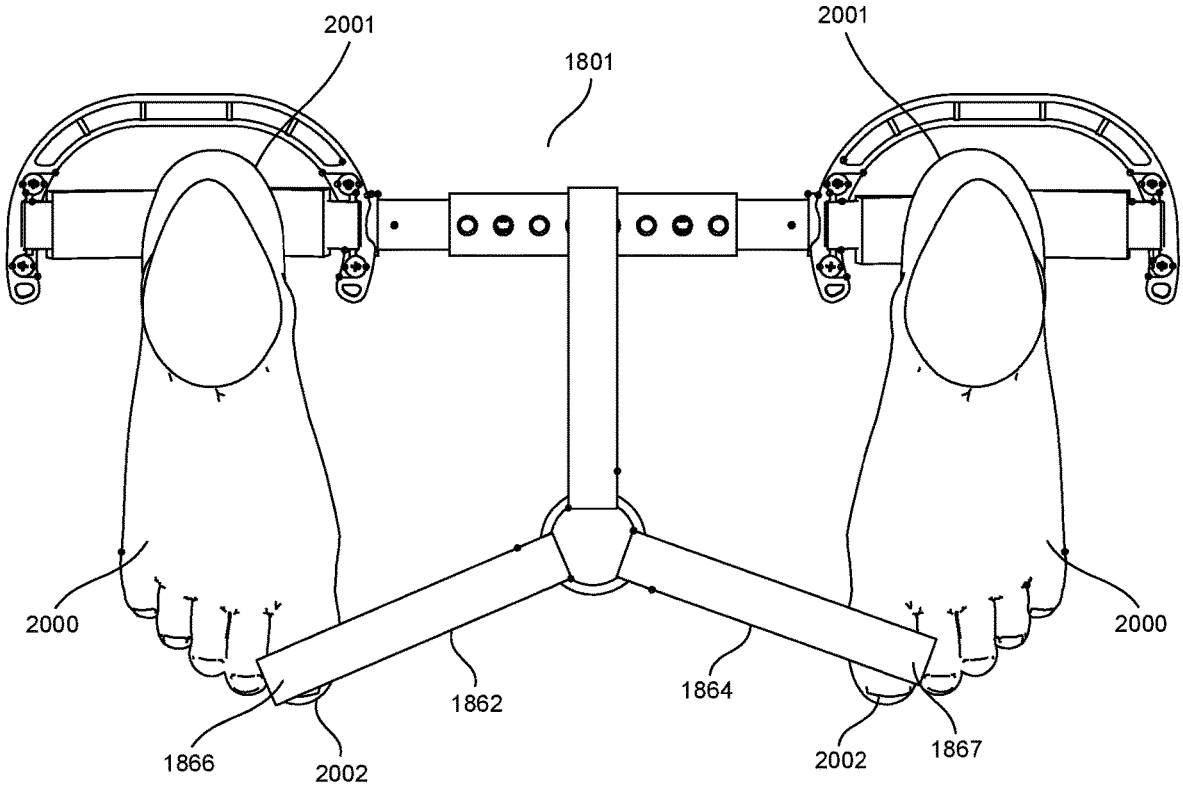
FIG. 20 is a top view of an alternate embodiment of the fascia activation and training device shown in FIG. 18, depicting a user's feet positioned within the end cuffs of the device, and a user's toes positioned within the toe straps of the device.
Figure 21:
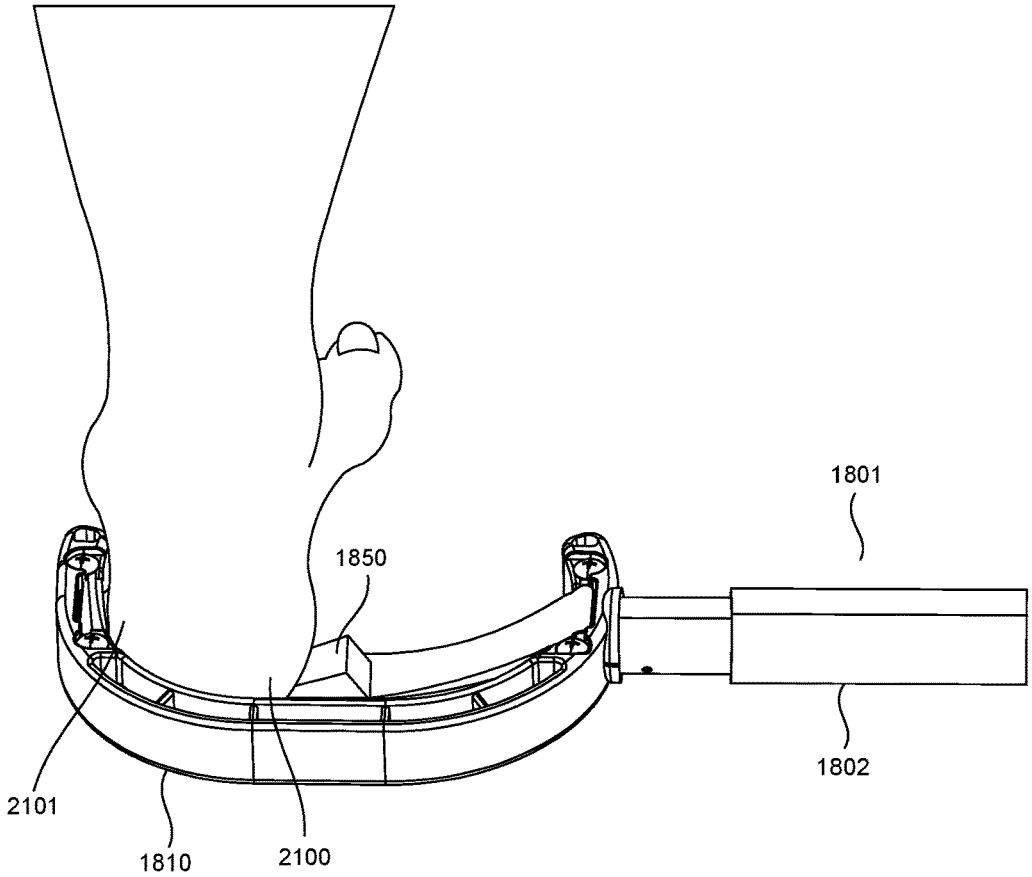
FIG. 21 is a partial perspective view of an end cuff of the alternate embodiment of the fascia activation and training device depicted in FIG. 18, depicting a user's foot positioned within said end cuff.

Referring now to FIG. 20, shown is a top view of the alternate embodiment of the fascia activation and training device illustrated in FIG. 18, depicting a user's feet positioned within the end cuffs of the device, and a user's toes (2002) positioned within the loops (1866, 1867) of toe straps (1862, 1864) of the training device (1801). As depicted in FIG. 20, the user's heels (2001) are positioned within the end cuffs of the training device (1801), and his or her big toes (2002) are each inserted into the respective loops (1866, 1867) of the toe straps (1862, 1864), which are in turn attached to the training device via a central strap (1860). It should be noted that while the embodiment of the toe strap depicted in FIGS. 18-20 comprises multiple strap segments joined by a ring, toe straps of alternate embodiments utilized in connection with the training device may comprise a unitary strap or multiple straps that may be joined by means other than a ring such, as for example, stitching.

Referring now to FIG. 21, shown is a partial perspective view of an end cuff (1810) of the alternate embodiment of the fascia activation and training device (1801) depicted in FIG. 18, illustrating a user's foot positioned within said end cuff. In this embodiment, having a tapered wedge (1850) positioned such that the thicker portion thereof is positioned inwardly, the wedge is configured to roll the user's foot outwardly such that the outer portion (2101) of the user's heel compresses against the outer contact surface of the end cuff (1810).

Referring now to FIG. 22, shown is a partial perspective view of an end cuff (1910) of the alternate embodiment of the fascia activation and training device (1901) illustrated in FIG. 19, depicting a user's foot positioned within said end cuff. In this embodiment, having a tapered wedge (1950) positioned such that the thicker portion thereof is positioned outwardly, the wedge is configured to roll the user's foot inwardly such that the inner portion (2200) of the user's heel compresses against the inner contact surface of the end cuff (1910).

Use of the embodiments of the training devices incorporating tapered wedges as discussed herein provides advantages to users not found in the prior art. The "ankle" has two joints that move in two movement planes. The true ankle joint comprises the talar joint and the subtalar joint. Where the tibia and fibula directly attach to the foot is the talar joint. This joint mainly moves to flex and extend the foot. The joint type is called a saddle joint, meaning that it has some movement from side to side as well. The subtalar joint is under the taler joint, supporting it, and acting as a torque converter for the body's movements, assisting people and athletes in changing direction in a rapid and accurate way. Incorporating the use of tapered wedges in the end cuffs configured for the positioning of a user's heels places the subtalar joint in a novel position by tilting it with the tapered wedges, then immobilizing the joint and setting it in an ideal position to carry out a contraction and loosen the structures surrounding the joint, including the joint capsule, tendons, and ligaments surrounding the joint. This torque conversion of this joint has effects up the body's leg (the biomechanical chain) into the hamstrings, sacroiliac joints, and the low back. Therefore, a dysfunction of this joint can have further-reaching effects than just the foot/ankle and is especially important for athletes and ankle instability. Orthotics are often prescribed in an attempt to correct problems with ankle instability, but often such orthotics give the person more pain, or do not help fully or in a satisfactory way. The training devices taught herein incorporating the use of tapered wedges in the end cuffs allow for self-mobilization to the sub talar joint with a coupled client-activated tendons that run on both sides of the area that also hold this joint (if stiff) in a stuck position.

Figure 23:
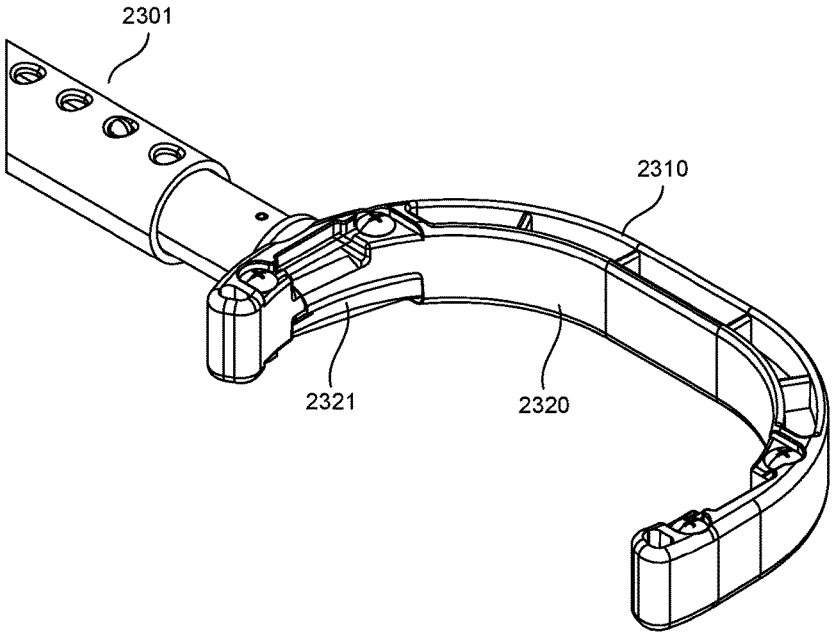
FIG. 23 is a partial perspective view of an end cuff of a further alternate embodiment of the fascia activation and training device depicted in FIGS. 1-2, said alternate embodiment having a pressure sensor mounted to said end cuff.

Referring now to FIG. 23, shown is a partial perspective view of an end cuff of a further alternate embodiment of the fascia activation and training device depicted in FIGS. 1-2, said alternate embodiment having a pressure sensor mounted to said end cuff. In this alternate embodiment of the training device (2301), a pressure sensor (2321) is mounted to the cuff arm inner contact surfaces (2320) of the end cuff (2310). The pressure sensor in this alternate embodiment is configured to transmit pressure data, via wire or wireless networks (not shown), to a computing device configured to receive and process such pressure data. The pressure sensor is further configured to collect pressure data associated with pressures applied to the sensor by a user's body when using the training device. While the pressure sensor depicted in FIG. 23 is mounted to an inward portion of the inner contact surface of the end cuff arm, the pressure sensor may be mounted at other locations inside the end cuff, and/or on or within the elongate device body, to collect pressure data associated with forces applied by a user at other such locations inside the end cuff. More than one pressure sensor may be mounted to each end cuff and or elongate device body. The pressure data collected by such pressure sensors can assist users and therapists in ascertaining the forces applied to the end cuff (or training device as a whole) by users, thus providing valuable feedback to the user and therapist.

Figure 24:
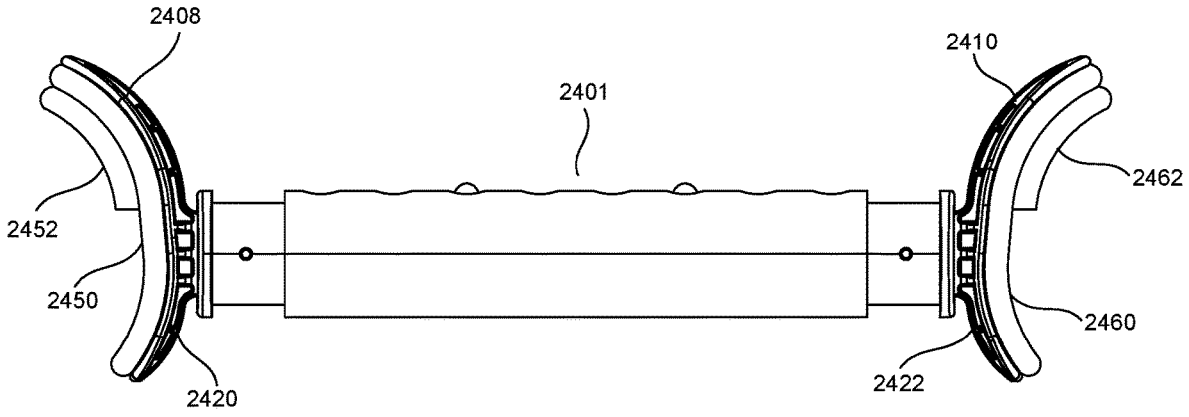
FIG. 24 a side view of an alternate embodiment of the fascia activation and training device depicted in FIGS. 3-4, said alternate embodiment having end cuffs with contact surfaces lined with contoured compression foam.

Referring now to FIG. 24, shown is a side view of an alternate embodiment of the fascia activation and training device depicted in FIGS. 3-4, said alternate embodiment having end cuffs with contact surfaces lined with contoured compression foam. In this embodiment, one or more layers of compression foam (2450, 2452, 2460, 2462) are attached to the cuff arm contact surfaces (2420, 2422) of the respective end cuffs (2408, 2410) of the training device (2401). Such one or more compression foam layers provides a contoured surface on the inner contact surfaces of the end cuffs, which not only makes use of the training device more comfortable for the user, but the contoured form of the foam layers can assist in positioning of the user's body members during use.

Figure 25:
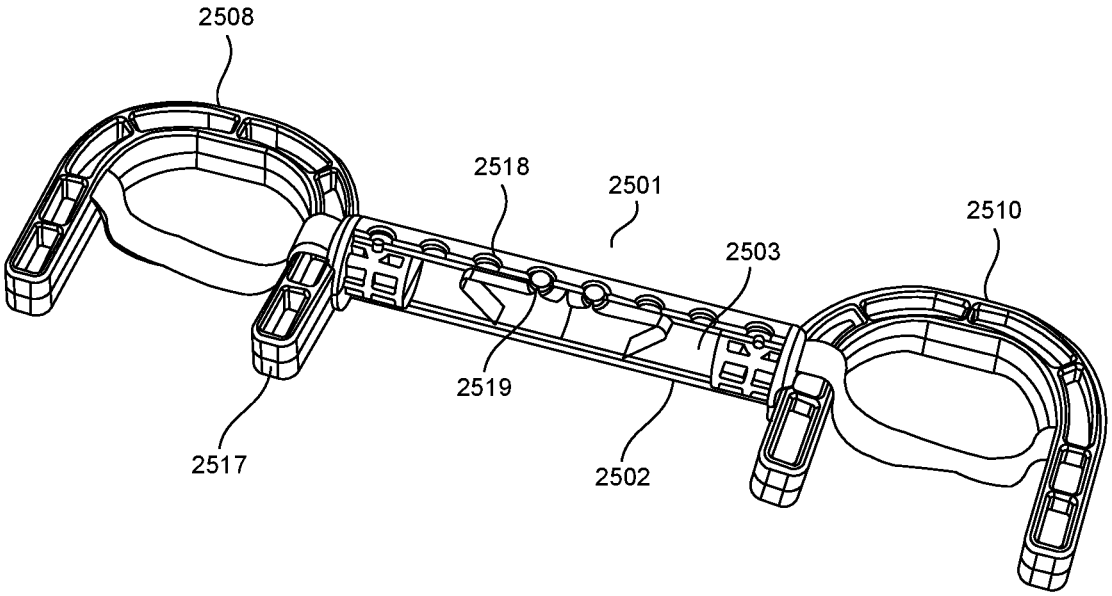
FIG. 25 is cutaway perspective view of an alternate embodiment of the fascia activation and training device depicted in FIGS. 1-2, said alternate embodiment having outwardly rotated end cuffs, and a locking mechanism configured to maintain a selectable length of the collapsible elongate device body.

Referring now to FIG. 25, shown is a cutaway perspective view of an alternate embodiment of the fascia activation and training device depicted in FIGS. 1-2, said alternate embodiment having extended end cuff ends (2517), and a locking mechanism configured to maintain a selectable length of the collapsible elongate device body. The length of the end cuff ends (2517) may vary based on the particular type of body member to be inserted into the end cuffs, and based on the size of the user. In other alternate embodiments, the end cuffs may have manually adjustable widths to allow the size of the end cuff to be customized for a user, depending on their size and the body member to be inserted into the end cuffs. In other alternate embodiments of the training device, the end cuffs (2508, 2510) may be outwardly or inwardly rotated in comparison to the embodiment depicted in FIGS. 1-2, and 25. Such rotation of the end cuffs in alternate embodiments of the training device may be in a lateral or vertical direction. It is contemplated that other alternate embodiments will include end cuffs having various orientations with respect to the elongate device body (2502), thus providing users and therapists with enhanced options for positioned user body members during fascial activation and training. Further, FIG. 25 illustrates a spring-operated detent mechanism (2519), mounted within a cavity (2503) of the hollow elongate device body, that engages detent holes (2518) formed in the elongate device body (2502). As previously discussed, the working length of the elongate device body can be adjusted by a user using the detent mechanism, the end portions of the elongate device body being slidable within the central portion thereof.

Figure 26:
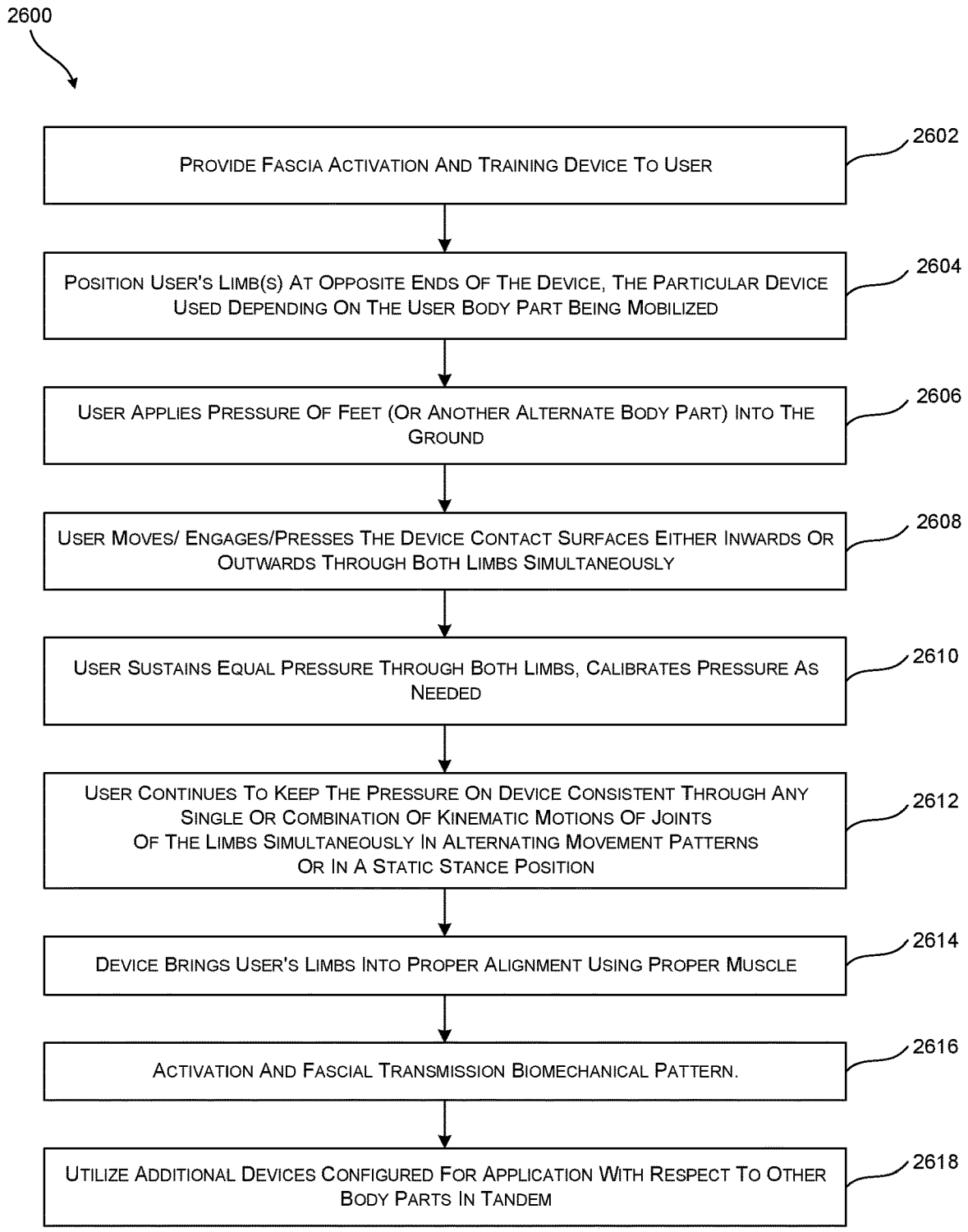
FIG. 26 is a flow chart illustrating a method embodiment of using the fascia activation and training device in accordance with aspects of the present disclosure.

Referring now to FIG. 26, shown is a flow chart illustrating a method (2600) embodiment of using the fascia activation and training device in accordance with aspects of the present disclosure. In step 2602, the user is provided with a training device in accordance with aspects of the present disclosure. In step 2604, the user's limbs are positioned at opposite ends of the training device—for example, within the end cuffs of an embodiment of the training device. It should be noted that both the selection of the training device, and the manner in which the user's limb's (or body members) are positioned within said training device, will depend on the particular body members being mobilized. In step 2606, the user will apply pressure of feet (or other body members, depending on the body member being mobilized) into the ground surface or floor surface. In step 2608, the user will move/engage/press the training device contact surfaces either inwards or outwards through both limbs/body members simultaneously. In step 2610, the user will sustain equal pressure through both limbs/body members, calibrating pressure as needed. In step 2612, the user continues to keep the pressure on the training device consistent though any single or combination of kinematic motions of joints of the limbs/body members simultaneously in alternating movement patterns or in a static stance position. In step 2614, the training device bring the user's limbs/body members into proper alignment using the proper muscles. In step 2616, the training device induces the activation and fascial transmission of a biomechanical pattern. In step 2618, additional training devices can be used for application with respect to other body members in tandem, thereby enhancing fascial activation. The method described above provides for isometric horizontal contraction sustained during a range of motion, causing co-contraction in a given area of an activated body member. This method sends efferent signals from the mechanoreceptors, proprioceptors, and other sensory and motor receptors in the targeted body member area to give the brain feedback on a new position as the body member is moving through a movement. Simultaneously, the movements associated with these methods result in the creation of new lubricative cells that help sustain the biomechanics of these new movements over time, even well after the movements have been completed. In one embodiment, a method for fascial activation and training comprising the following steps is disclosed: providing a user with an elongate device body having a first end and a second end; a first cuff attached to said first end of said elongate device body; and a second cuff attached to said second end of said elongate device body, wherein each of said first cuff and said second cuff have a curved arm, wherein each of said first cuff and said second cuff is sized to receive a body member of a device user, and wherein user has a first body member and a second body member; positioning said first body member within said first cuff, and positioning said second body member within said second cuff; and receiving, at said first cuff and said second cuff, inward pressure or outward pressure applied by said first body member and said second body member, respectively; sustaining, at the respective end cuffs, equal pressure through said first body member and said second body member; maintaining, by the user, consistent said equal pressure through any combination of kinematic motions of said first body member and said second body member simultaneously in alternating movement patterns or in a static stance position; bringing into alignment, by the training device, said first body member and said second body member; inducing, by said training device, an activation and fascial transmission of a biomechanical pattern; positioning a third body member and a fourth member of said user in a second training device; and applying, by the user, pressure of said first body and said second body member into a ground surface or a floor surface.

The invention may be embodied in other specific forms without departing from the spirit or essential characteristics thereof. The present embodiments are therefore to be considered in all respects as illustrative and not restrictive. Accordingly, the scope of the invention is established by the appended claims rather than by the foregoing description. All changes that come within the meaning and range of equivalency of the claims are embraced therein. Further, the recitation of method steps does not denote a particular sequence for execution of the steps. Such method steps may therefore be performed in a sequence other than that recited unless the particular claim expressly states otherwise.

I claim:

1. A training device comprising:

an elongate device body having a first end and a second end;

a first end cuff attached to said first end of said elongate device body; and a second end cuff attached to said second end of said elongate device body, wherein each of said first end cuff and said second end cuff is sized to receive at least a portion of a different foot of a device user, wherein each of said first end cuff and second end cuff are curved in shape, each having a respective proximal end that is connected to a respective distal end, wherein a respective laterally oriented opening is formed between the respective proximal end and distal end of each of said first end cuff and said second end cuff, wherein respective opposing ends of a first strap are attached adjacent to said proximal end and adjacent to said distal end of said first end cuff, wherein respective opposing ends of a second strap are attached adjacent to said proximal end and adjacent to said distal end of said second end cuff, wherein a first wedge is attached to a first top side of said first strap, and a second wedge is attached to a second top side of said second strap, wherein each of said first wedge and said second wedge have a thickness that continuously varies from respective proximal ends to respective distal ends of said respective first wedge and said second wedge to inwardly or outwardly roll said a different foot of said device user resting thereon.

2. The training device of claim 1, wherein said first end cuff and said second end cuff are removably attached to said elongate device body.

3. The training device of claim 2, wherein said first end cuff and second end cuff are "U" shaped.

4. The training device of claim 1, wherein said first wedge is attached to said first top side of said first strap via first hook and loop fasteners, and wherein said second wedge is attached to said second top side of said second strap via second hook and loop fasteners.

5. The training device of claim 1, wherein said first strap and said second strap have lengths that are user adjustable.

6. The training device of claim 1, wherein each said first end cuff and second end cuff each have an inside contact surface lined with a compressible foam.

7. The training device of claim 1, further comprising a first central strap attached to said elongate device body, said first central strap having a distal end attached to a ring, and two secondary straps each having a proximal end attached to said ring, wherein respective distal ends of said two secondary straps have loops formed thereon, each of said loops configured to receive a big toe of a user of said training device.

8. The training device of claim 1, further comprising a pressure sensor mounted to one of said first end cuff or said second end cuff.

9. The training device of claim 1, wherein said first end cuff is hingedly attached to said first end of said elongate device body, and wherein said second end cuff is hingedly attached to said second end of said elongate device body.

10. A training device comprising:

an elongate device body having a first end and a second end;

a first end cuff attached to said first end of said elongate device body;

a second end cuff attached to said second end of said elongate device body, wherein each of said first end cuff and said second end cuff is sized to receive at least a portion of a different foot of a device user, wherein respective opposing ends of a first strap are attached to opposing ends of the first end cuff, wherein respective opposing ends of a second strap are attached to opposing ends of the second end cuff, wherein a first wedge is attached to a first top side of said first strap, and a second wedge is attached to a second top side of said second strap, wherein each of said first wedge and said second wedge has a thickness that continuously varies along a longitudinal direction of the respective first strap and second strap to inwardly or outwardly roll said a different foot of said device user; and a first central strap having a proximal end attached to said elongate device body, said first central strap having a distal end attached to a ring, and two secondary straps each having a proximal end attached to said ring, wherein respective distal ends of said two secondary straps have loops formed thereon, each of said loops configured to receive a big toe of the device user.

11. The training device of claim 10, wherein said elongate device body is collapsible, hollow and has a user-adjustable length.

12. The training device of claim 11, wherein a compression spring is mounted within said elongate device body.

13. The training device of claim 12, wherein a first inwardly projecting protrusion is formed on said first end cuff, and wherein said first inwardly projecting protrusion projects inwardly inside said elongate device body, wherein at least one detent is formed on said first inwardly projecting protrusion, wherein at least one detent slot is formed on said elongate device body, and wherein said at least one detent is sized and shaped to at least temporarily engage said at least one detent slot to hold said first end cuff in a fixed position with respect to said elongate device body.

14. A method for fascial activation and training comprising the following steps:

a.) providing a user with an elongate device body having a first end and a second end;

a first end cuff attached to said first end of said elongate device body; and a second end cuff attached to said second end of said elongate device body, wherein each of said first cuff and said second cuff is sized to receive at least a portion of a different body member of said user, wherein each of said first end cuff and second end cuff are curved in shape, each having a respective proximal end that is connected to a respective distal end, wherein a respective laterally oriented opening is formed between the respective proximal end and distal end of each of said first end cuff and said second end cuff, wherein respective opposing ends of a first strap are attached adjacent to said proximal end and adjacent to said distal end of said first end cuff, wherein respective opposing ends of a second strap are attached adjacent to said proximal end and adjacent to said distal end of said second end cuff, wherein a first wedge is attached to a first top side of said first strap, and a second wedge is attached to a second top side of said second strap, wherein each of said first wedge and said second wedge have a thickness that continuously varies from respective proximal ends to respective distal ends of said respective first wedge and said second wedge to inwardly or outwardly roll said different body members of said device user resting thereon, and wherein said user has a first body member and a second body member;

b.) positioning said first body member within said first end cuff, and positioning said second body member within said second end cuff; and c.) receiving, at said first end cuff and said second end cuff, inward pressure or outward pressure applied by said first body member and said second body member, respectively.

15. The method for fascial activation and training of claim 14, further comprising the step of sustaining, at the respective first and second end cuffs, equal pressure through said first body member and said second body member.

16. The method for fascial activation and training of claim 15, further comprising the step of maintaining, by the user, consistent said equal pressure through said first body member and said second body member by pressing inward or outward on said respective first and second end cuffs simultaneously in alternating movement patterns or in a static stance position.

17. The method for fascial activation and training of claim 16, further comprising the step of bringing into alignment, by the training device, said first body member and said second body member.

18. The method for fascial activation and training of claim 17, further comprising the step of inducing, by said training device, an activation of fascia of said first body member and second body member.

19. The method for fascial activation and training of claim 18, further comprising the step of positioning a third body member and a fourth body member of said user in a second training device.

20. The method for fascial activation and training of claim 14, further comprising the step of applying, by the user, pressure of said first body member and said second body member into a ground surface or a floor surface.

* * * * *